US008326184B2

(12) United States Patent
Kudo et al.

(10) Patent No.: US 8,326,184 B2
(45) Date of Patent: Dec. 4, 2012

(54) DEVELOPMENT DEVICE AND IMAGE FORMING APPARATUS

(75) Inventors: Norio Kudo, Kawasaki (JP); Yasuo Miyoshi, Yokohama (JP); Hiroshi Hosokawa, Yokohama (JP); Yoshihiro Fujiwara, Yokohama (JP); Hiroaki Okamoto, Zama (JP)

(73) Assignee: Ricoh Company, Limited, Tokyo (JP)

( * ) Notice: Subject to any disclaimer, the term of this patent is extended or adjusted under 35 U.S.C. 154(b) by 20 days.

(21) Appl. No.: 12/832,402

(22) Filed: Jul. 8, 2010

(65) Prior Publication Data

US 2011/0008073 A1 Jan. 13, 2011

(30) Foreign Application Priority Data

Jul. 8, 2009 (JP) ..... 2009-161911
Sep. 15, 2009 (JP) ..... 2009-212574
Dec. 25, 2009 (JP) ..... 2009-294609

(51) Int. Cl.
*G03G 15/08* (2006.01)

(52) U.S. Cl. ..... 399/253; 399/254; 399/272; 399/281

(58) Field of Classification Search ..... 399/53, 399/222, 252–256, 265, 272, 276, 279, 281
See application file for complete search history.

(56) References Cited

U.S. PATENT DOCUMENTS 4,468,111 A * 8/1984 Yamagata et al. ..... 399/272
4,676,192 A * 6/1987 Yuge et al. ..... 399/259
5,627,630 A 5/1997 Matsumae et al.
5,758,240 A * 5/1998 Ito et al. ..... 399/267
5,819,145 A 10/1998 Tanaka et al.
5,826,144 A 10/1998 Takenaka et al.
5,879,752 A 3/1999 Murakami et al.
6,163,666 A 12/2000 Hosokawa et al.
6,212,343 B1 4/2001 Hosokawa et al.
6,259,876 B1 * 7/2001 Fukuda et al. ..... 399/254
6,505,014 B2 1/2003 Aoki et al.
6,560,431 B2 5/2003 Hosokawa (Continued)

FOREIGN PATENT DOCUMENTS

JP 62247383 A * 10/1987

(Continued)

OTHER PUBLICATIONS

U.S. Appl. No. 12/709,022, filed Feb. 19, 2010, Yoshihiro Fujiwara, et al.

(Continued)

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A development device includes a developer container internally divided by a partition into a supply path and a recovery path, a developer bearing member, a supply conveyance member to apply force to convey developer to a developer retaining space through the supply path, the developer retaining space retaining the developer to be conveyed by the developer bearing member, a recovery conveyance member, a communication pathway provided between the supply path and the developer retaining space, the communication pathway passing the developer from the supply path to the developer retaining space, and a developer softening member to soften the developer that is present above the partition, provided at least one of at a position in the communication pathway and at a position close to the communication pathway.

7 Claims, 27 Drawing Sheets

U.S. PATENT DOCUMENTS

| | | | |
|---|---|---|---|
| 6,658,227 | B2 | 12/2003 | Oyama et al. |
| 6,671,484 | B2 | 12/2003 | Miyoshi et al. |
| 6,721,516 | B2 | 4/2004 | Aoki et al. |
| 6,901,233 | B2 | 5/2005 | Aoki et al. |
| 7,024,133 | B2 | 4/2006 | Nagashima et al. |
| 7,035,575 | B2 | 4/2006 | Ikeguchi et al. |
| 7,076,192 | B2 | 7/2006 | Tsuda et al. |
| 7,106,991 | B2 | 9/2006 | Hosokawa et al. |
| 7,136,610 | B2 | 11/2006 | Arai et al. |
| 7,209,685 | B2 | 4/2007 | Oyama et al. |
| 7,212,767 | B2 | 5/2007 | Hosokawa et al. |
| 7,321,744 | B2 | 1/2008 | Hosokawa et al. |
| 7,398,038 | B2 | 7/2008 | Tsuda et al. |
| 7,428,393 | B2 | 9/2008 | Hosokawa et al. |
| 7,480,475 | B2 | 1/2009 | Miyoshi et al. |
| 7,480,476 | B2 | 1/2009 | Hosokawa et al. |
| 7,519,317 | B2 | 4/2009 | Hosokawa et al. |
| 7,536,141 | B2 | 5/2009 | Miyoshi |
| 7,599,649 | B2 | 10/2009 | Miyoshi |
| 7,650,101 | B2 | 1/2010 | Hosokawa et al. |
| 7,697,870 | B2 | 4/2010 | Hosokawa et al. |
| 2007/0166074 | A1 | 7/2007 | Hosokawa et al. |
| 2008/0056747 | A1 | 3/2008 | Miyoshi |
| 2008/0145107 | A1 | 6/2008 | Miyoshi |
| 2008/0286013 | A1 | 11/2008 | Hosokawa et al. |
| 2009/0169264 | A1 | 7/2009 | Miyoshi et al. |
| 2009/0232558 | A1 | 9/2009 | Kudo et al. |
| 2009/0238610 | A1 | 9/2009 | Miyoshi et al. |
| 2010/0014895 | A1 | 1/2010 | Hosokawa et al. |
| 2010/0119264 | A1 | 5/2010 | Yamaguchi et al. |

FOREIGN PATENT DOCUMENTS

| | | | |
|---|---|---|---|
| JP | 10-149027 | | 6/1998 |
| JP | 11-167261 | | 6/1999 |
| JP | 3104722 | | 9/2000 |
| JP | 2003-173086 | * | 6/2003 |
| JP | 2003-263012 | | 9/2003 |
| JP | 2004-354529 | | 12/2004 |
| JP | 2007-003864 | | 1/2007 |

OTHER PUBLICATIONS

U.S. Appl. No. 12/700,834, filed Feb. 5, 2010, Yasuo Miyoshi, et al.

* cited by examiner

DEVELOPMENT DEVICE AND IMAGE FORMING APPARATUS

CROSS-REFERENCE TO RELATED APPLICATIONS

This patent specification claims priority from Japanese Patent Application Nos. 2009-161911, filed on Jul. 8, 2009, 2009-212574, filed on Sep. 15, 2009, and 2009-294609, filed on Dec. 25, 2009 in the Japan Patent Office, the contents of which are hereby incorporated by reference herein in their entirety.

BACKGROUND OF THE INVENTION

1. Field of the Invention

The present invention relates to a development device and an image forming apparatus such as a copier, a printer, a facsimile machine, a plotter, and a multi-function machine that includes the same.

2. Discussion of the Background

Electrophotographic image forming apparatuses such as copiers, printers, facsimile machines, plotters, multi-function machines, or the like typically include a development device and a transfer unit. The development device develops a latent image formed on a photoreceptor serving as a latent image carrier into a visible toner image. The transfer unit transfers the toner image from the photoreceptor onto a recording medium (e.g., transfer sheet) to form an image on the recording medium.

At present, the development device develops latent images into toner images using either one-component developer or two-component developer. The one-component developer consists of magnetic or non-magnetic toner. On the other hand, the two-component developer includes toner and carrier particles for carrying the toner. The development device develops the latent image formed on the latent image carrier with the developer including the toner and the carrier.

As for the development device using two-component developer, a configuration that includes a developing sleeve serving as a developer bearing member to bear the developer on a surface thereof and enwrap a magnetic-field generating member that generates multiple magnet poles is known. This development device includes a supply path from which the developer is conveyed to the developing sleeve in a direction parallel to an axis of the developing sleeve. Toner is consumed to develop the latent image on the photoreceptor and accordingly toner concentration (the content of the toner in the developer) of the developer after passing through the developing range decreases. If the developer supplied from the supply path to the developing sleeve that has passed the developing range formed between the photoreceptor and the developing sleeve is directly sent back to the supply path, the toner concentration of the developer decreases as the developer flows downstream in the supply path in a direction of conveyance of the developer (hereinafter "developer conveyance direction").

Therefore, there are development devices that further include a recovery path through which the developer that reaches an extreme downstream of the supply path is transported to an upstream side of the supply path.

Published Unexamined Japanese Patent Application No. (hereinafter referred to as JP-A-) H05-333691 discloses a development device that includes supply path and a recovery path disposed in parallel to the developing sleeve. In this development device, developer is supplied from the supply path to the developing sleeve, and the developer supplied to the developing sleeve is conveyed to the recovery path after development, that is, after passing through the developing range. Specifically, the developer having lower toner concentration after passing through the developing range is not returned to the supply path but is instead conveyed to the recovery path and discharged from the sleeve. As a result, the toner concentration of the developer at a downstream end of the supply path relative to the direction of conveyance of the developer is not decreased.

In this example, a supply screw, serving as a supply conveyance member to convey the developer, formed of a rotation shaft with bladed spiral portion, is provided in the supply path, and the developing sleeve is disposed above the supply screw. The developer in the supply path is pumped up to the developing sleeve due to a magnetic force exerted by a magnetic field generating member provided in the developing sleeve.

However, when the supply screw is used for the supply conveyance member, the level of the developer in the supply path fluctuates following the shape of the spiral blade. Due to the fluctuation in the supply amount of the developer to the developing sleeve, unevenness of image density (screw pitch fluctuation) is generated.

In addition, in this development device, because the developer supplied from the supply path to the developing sleeve is not returned to the supply path, the amount of the developer decreases gradually as the developer flows downstream in the supply path, and the developer gradually increases as the developer flows downstream in the recovery path. Therefore, the dispersion of the amount of the developer is uneven in the development device. Consequently, when the amount of the developer supplied to the developing range fluctuates, even when the toner concentration of the developer is uniform, images of uneven image density are generated.

Accordingly, in order to prevent the decrease of the developer as the developer flows downstream, in this development device, rotation velocity of the supply screw and the recovery screw can be increased, so that a sufficiently larger amount of the developer is conveyed in the supply path and the recovery path. As a result, unevenness in the amount of the developer at the upstream end and the downstream end in the supply path is reduced. However, faster rotation velocity of the screws causes larger stress to the developer, resulting in deterioration in the developer. Further, the faster rotation velocity of the screws also causes an increase in torque, causing abrasion of mechanical components such as roller bearings. In other words, there is a limit to how much the rotation velocity of the screws can be increased, imposed by the need to prevent shortening the life of the development device and the developer. In addition, the cost is increased.

As another example, JP-H11-167261-A proposes a development device in which a supply path is provided above the developing sleeve, a wall separates the supply path from the development sleeve, and the developer is supplied from the supply path to the developing sleeve via a communication pathway provided above the wall separating the supply path and the developing sleeve. The developer from the supply path passes over the wall, dives, and then is supplied to the developing sleeve under its own weight to the surface of the developing sleeve 34*a*.

In this example, while the developer passes over the wall and then dives to the surface of the developing sleeve, the unevenness of amount of the developer (screw pitch fluctuation) supplied to the developing sleeve can be prevented. However, because the developer is conveyed by only gravity, the developer may accumulate close to an upper end of the wall. If the developer accumulates, image failures such as image fade or white lines in image may occur.

In addition, in this example, the wall between the supply path and the communication pathway is higher the farther downstream because the level of the developer is higher on the upstream side and lower on the downstream side in the supply path. In this example, the unevenness in the supply amount of the developer to the developing sleeve can be ameliorated.

However, the level of the developer fluctuates with time in this development device, and when the excessive developer is conveyed to the developing sleeve, the amount of the developer conveyed to an area between the developer regulator and the developing sleeve is increased, and the excess pressure is exerted on the developer and therefore, the developer deteriorates and the life of the developer is decreased.

Accordingly, there is a need for a technology to better control the supply of developer to the developing sleeve.

SUMMARY OF THE INVENTION

In view of foregoing, one illustrative embodiment of the present invention provides a development device that includes a developer bearing member, a supply conveyance member, a developer softening member, and a developer container that is internally substantially divided by a partition into a supply path and a recovery path disposed parallel to the supply path. A developer retaining space and a communication pathway are formed within the developer container. The developer bearing member is housed partially within the developer container and is rotated while bearing developer on a surface thereof, to supply toner to a latent image formed on a surface of a latent image carrier within a developing range that is a portion of the developer bearing member disposed opposite the latent image carrier to develop the latent image with the toner. The supply conveyance member is disposed within the supply path to apply a force to convey the developer through the supply path in an axial direction of the developer bearing member perpendicular to a direction in which the developer bearing rotates while supplying the developer to the developer retaining space. The developer retaining space is in communication with the supply path within the developer container and retains the developer to be conveyed by the developer bearing member as the developer bearing member rotates. The recovery conveyance member is disposed within the recovery path to apply a force conveys the developer through the recovery path The developer reaching a downstream end of the supply path is returned to an upstream end of the supply path in a direction of conveyance of the developer. The communication pathway is defined by a top of the partition and an interior ceiling of the developer container and is provided between the supply path and the developer retaining space. The developer is passed from the supply path to the developer retaining space. The developer softening member softens the developer that is present above the partition, provided at least one of at a position in the communication pathway and at a position close to the communication pathway.

Another illustrative embodiment of the present invention provides an image forming apparatus that includes a latent image carrier to carry a latent image, a charging device to electrically charge a surface of the latent image carrier, and the development device described above, to develop the latent image formed on the latent image carrier.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
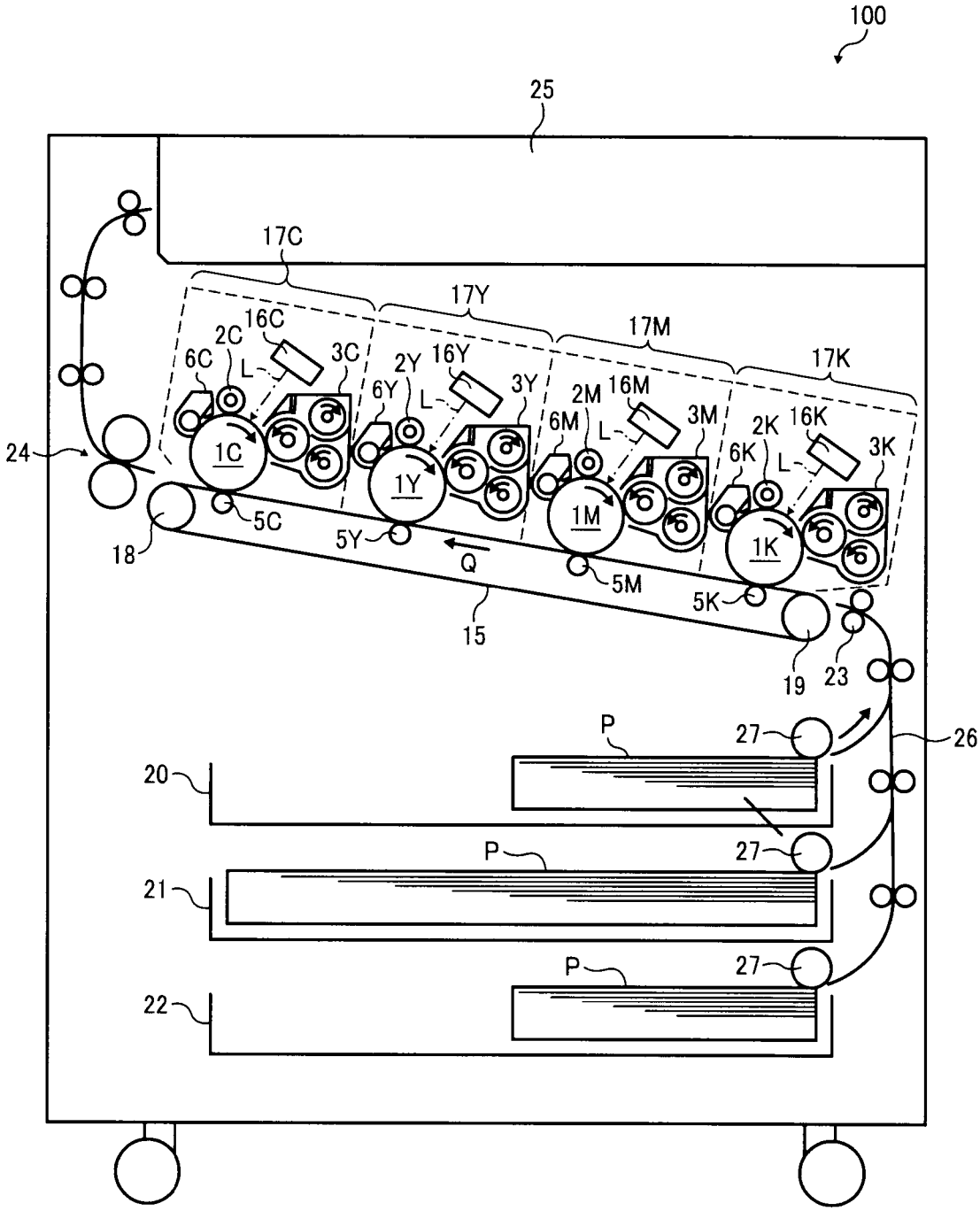
FIG. 1 is an overall schematic view illustrating a configuration of an image forming apparatus including a development device according to one illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

(Printer)

FIG. 1 is a schematic diagram illustrating a configuration of an image forming apparatus 100 including a development device of the present embodiment. A description is now given of a tandem-type color laser printer (hereinafter referred to as an image forming apparatus 100) according to illustrative embodiments.

The image forming apparatus 100 shown in FIG. 1 includes a transfer-transport belt 15 and image forming units 17Y, 17M, 17C, and 17K. The image forming units 17Y, 17M, 17C, and 17K for respectively forming black, magenta, cyan, and yellow (hereinafter also simply "K, M, C, and Y") single-color toner images are disposed facing transfer bias rollers 5Y, 5M, 5C, and 5K via the transfer-transport belt 15 that is stretched by a downstream tension roller 18 and an upstream tension roller 19, and seamlessly rotated in a clockwise direction in FIG. 1 with carrying a sheet P.

It is to be noted that, in this specification, reference character suffixes Y, M, C, and K attached to an identical reference numeral indicate only that components indicated thereby are used for forming different single-color images, respectively, and hereinafter may be omitted when color discrimination is not necessary.

An unfixed four-color toner image form on the sheet P separated from the transfer-transport belt 15 is fixed on the surface of the sheet P with heat and pressure in a fixing device 24. The fixing device 24 is positioned downstream a direction in which the sheet P is conveyed from the downstream tension roller 18.

Additionally, a discharge sheet tray 25 is located in an upper portion of the image forming apparatus 100 to stack the sheet P.

Multiple feeding cassettes 20, 21, and 22 are disposed in a lower portion of the image forming apparatus 100 and contain transfer sheets P. A sheet feed device 27, serving as a recording medium feed device, feeds the sheets P one-by-one to transfer ranges formed between the transfer-transport belt 15 and the image forming units 17Y, 17M, 17C, and 17K via the sheet feed path 26.

A pair of registration rollers 23 transport the sheet P toward the transfer-transport belt 15 timed to coincide with the arrival of imaged formed in the image forming unit 17K, 17M, 17Y, and 17C.

It is to be noted that, in order to make the printer 100 compact in a lateral direction in FIG. 1, the transfer-transport belt 15 is slant in a direction indicated by arrow Q in which the sheet P is conveyed. Accordingly, the width of the body of the printer 100 can be only a length slightly longer than the longitudinal direction of A3-sized sheet.

That is, the slant transfer-transport belt 15 can reduce the size of the printer 100 compact dramatically to only a required size to contain the transfer sheets in inner portion.

As shown in FIG. 1, each of the image forming units 17 includes a drum-shaped photoreceptor 1 functioning as a latent image carrier, and a charging device 2, a development device 3, and a cleaning device 6 are disposed around the photoreceptor 1. Each image forming unit 17 further includes the exposure device (optical writing member) 16 positioned above the photoreceptor 1 in FIG. 1 that irradiates the surface of the photoreceptor 1 in a portion between the charging device 2 and the development device 3 with a laser light L in accordance with image data. It is to be noted that the photoreceptor 1 can have also a belt-shape instead of the drum-shape.

In the above-described printer 100, when the image forming process is executed, initially, respective single-color toner images are formed in the image forming units 17.

The photoreceptor 1 is rotated clockwise by a main motor, not shown, and, the surface of the photoreceptor 1 is uniformly charged in a portion facing the charging device 2.

When the surface of the photoreceptor 1 reaches a portion receiving the laser light L emitted from the exposure device 16, the laser light L scans the surface of the photoreceptor 1, thus forming a latent image on the portion receiving the laser light L.

Then, the portion of the surface of the photoreceptor 1 reaches a portion facing the development device 3, and the latent image thereon is developed into a toner image with the toner included in developer supplied from the development device 3.

At this time, the transfer sheet P fed from the feed cassette 20, 21, or 22 is stopped by the pair of registration rollers 23, after which the pair of the registration rollers 23 convey the transfer sheet P toward the surface of the transfer-transport belt 15 concurrently with the image formation in the image forming units 17. Then, the transfer sheet P on the transfer-transport belt 15 is conveyed to the respective color of the transfer ranges.

After that, the toner images formed on the respective photoreceptors 1Y, 1M, 1C, and 1K in the development process are transferred from the photoreceptors 1 and superimposed one on another on the surface of the transfer sheet P. Thus, the toner images formed on the respective photoreceptors 1 are transferred in order of black (K), magenta (M), yellow (Y), and cyan (C) and superimposed one on another on the surface of the transfer sheet P.

The transfer-sheet P onto which multicolor image is transferred is separated from the transfer-transport belt 15 and transported to the fixing device 24, where the four-color toner image thus transferred is fixed on the surface of the transfer sheet P with heat and pressure. After which, the transfer sheet P is discharged toward the discharge sheet tray 25.

Along with these processes, the surface of the photoreceptor 1 reaches a portion facing the cleaning device 6, where un-transferred toner that remains on the surface of the photoreceptor 1 is removed by the cleaning device 6, and electrical potential on the surface of the photoreceptor 1 is discharged by a discharge lamp, not shown, as appropriate.

Undergoing these processes, the image forming process performed on the photoreceptor 1 is completed, and the photoreceptors 1 are charged by the charging device 2Y, 2M, 2C, and 2K repeatedly.

First Embodiment

Next, a configuration of the development device 3 is described below.

Figure 2:
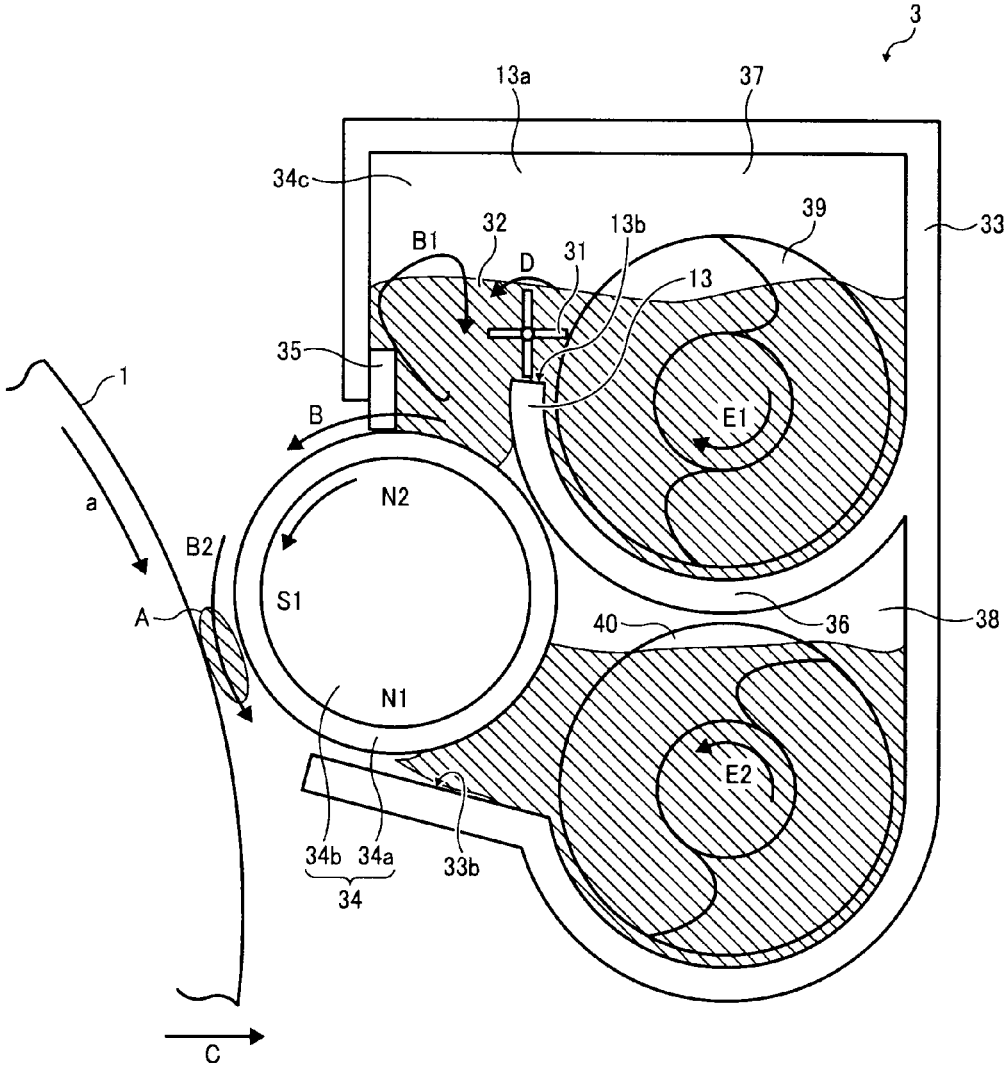
FIG. 2 illustrates a schematic configuration of the development device shown in FIG. 1.

FIG. 2 illustrates a schematic configuration of the development device 3 according to a first embodiment.

As described above, the development devices 3 are disposed facing the respective photoreceptors 1 that are rotated clockwise in a direction indicated by arrow a in FIG. 2.

In the development device 3, a developer container 33 serving as a casing of the development device 3 contains developer 32. The developer 32 is a powder, and includes two components: a magnetic carrier and magnetic or nonmagnetic toner. The development device 3 includes a development roller 34. The development roller 34 includes a developing sleeve 34*a* serving as a developer bearing member to bear the developer 32 on a surface thereof to convey the developer 32 in the developer container 33 to a developing range A. Inside the developing sleeve 34*a* is a magnet roller 34*b* including multiple stationary magnets fixed in place with respect to the development device 3. The magnet roller 34*b* includes three magnetic poles (two negative magnetic poles N1 and N2 and one positive magnetic pole S1. The development device 3 further includes a developer regulator 35 to restrict a thickness of the developer 32 borne on the surface of the developing sleeve 34*a*.

In the development device 3, two substantially parallel screws, a supply screw 39 and a recovery screw 40, are arranged parallel to an axial direction of the developing sleeve 34*a*, each screw serving as a conveyance member for conveying the developer 32 in the axial direction of the developing sleeve 34*a*. Each of the supply screw 39 and the recovery screw 40 includes a rotary axis and a blade extending spirally along a length of the rotary axis, and is rotated to convey the developer 32 in a given direction along the axis of the rotary axis thereof.

Inner walls and a partition 36 divide an interior of the developer container 33 and define a supply path 37 and a recovery path 38 each serving as a developer conveyance path formed one above the other with the partition 36 therebetween. The partition 36 includes an opening on each end on front side and backside thereof in FIG. 2 so that the supply path 37 and the recovery path 38 communicate via the two openings, respectively. As illustrated in FIG. 2, the supply path 37 is positioned next to and slightly above the developing sleeve 34*a* with a wall portion 13 therebetween, and the recovery path 38 is positioned next to and below the supply path 37 with the partition 36 therebetween. The partition 36 partially envelopes the supply screw 39, and the standing portion thereof is called as the wall portion 13.

Additionally, the development device 3 further includes a paddle member 31 provided above the wall portion 13, which is described in further detail later.

Although the wall portion 13 obstructs the conveyance of the developer 32 between the development sleeve 34*a* and the supply screw 39, but it also defines a space, hereinafter referred to as a communication pathway 13*a*, that is defined by an upper end 13*b* of the wall portion 13 and an upper position of the interior ceiling of the developer container 33. The communication pathway 13*a* is defined by the supply path 37 and the developer retaining space 34*c*.

The developer 32 stored in the supply path 37 is conveyed by rotation of the supply screw 39 to be supplied from the communication pathway 13*a* to the surface of the developing sleeve 34*a*.

The developer 32 supplied from the communication pathway 13*a* to the developing sleeve 34*a* is stored in a developer retaining space 34*c* defined by the wall portion 13, the surface of the developing sleeve 34*a*, and the interior wall of the developer container 33.

The developer 32 retained in the developer retaining space 34*c* contacts the surface of the developing sleeve 34*a*, and the developer contacting the surface of the developing sleeve 34*a* is borne on the surface of the developing sleeve 34*a* as the developing sleeve 34*a* rotates. Then, the developer 32 thus borne on the surface of the developing sleeve 34*a* is conveyed to the developing range A, as the developing sleeve 34*a* rotates.

The communication pathway 13*a* extends in the axial direction of the developing sleeve 34*a*, which allows supplying the developer 32 from the supply path 37 to the developing sleeve 34*a* over a developing width entirely.

As shown in FIG. 2, the supply screw 39 and the recovery screw 40 are disposed in the supply path 37 and the recovery path 38, respectively. The developer 32 in the developer container 33 is stored in the supply path 37, the recovery path 38, and the developer retaining space 34*c*. The recovery screw 40 is arranged substantially in parallel to the supply screw 39, and the developer 32 in the recovery path 38 is conveyed by the recovery screw 40 in a direction opposite a direction of conveyance of the developer 32 (hereinafter "developer conveyance direction") conveyed by the supply screw 39 in the supply path 37.

As the supply screw 39 and the recovery screw 40 rotate, the developer 32 in the developer container 33 is circulated between the supply path 37 and the recovery path 38 through the two openings respectively provided on the ends of the partition 36.

It is to be noted that the supply screw 39 rotates in a clockwise direction indicated by arrow E1 shown in FIG. 2, and the recovery screw 40 rotates in a counterclockwise direction indicated by arrow E2, similarly to the developing sleeve 34*a*.

The developer 32 stored in the supply path 37 is conveyed by rotation of the supply screw 39, passing over the wall portion 13, to the developer retaining space 32*c*, after which, the developer 32 is supplied to the surface of the developing sleeve 34*a*.

The developer 32 attracted to the developing sleeve 34*a* due to a magnetic force from the magnet roller 34*b* provided in the developing sleeve 34*a* is conveyed toward a direction indicated by arrow B shown in FIG. 2.

While the developer 32 borne on the developing sleeve 34*a* passes a restriction area facing the developer regulator 35, the developer regulator 35 scrapes off excessive developer 32 from the developing sleeve 34*a* as indicated by arrow B1. Thus, only a predetermined or given amount of the developer 32 passes the developer regulator 35 in the direction indicated by the arrow B.

Then, the predetermined amount of the developer 32 passes through the developing range A as indicated by arrow B2, after which the developer 32 leaves the developing sleeve 34*a*, flows to a bottom portion 33*b* of the developer container 33, and enters the recovery path 38. Thus, the developer 32 that is not supplied to the photoreceptor 1 but remains on the developing sleeve 34*a* after passing through the developing range A is collected in the recovery path 38 instead of being transported to the supply path 37 immediately as the developing sleeve 34*a* rotates. In the recovery path 38, the collected developer 32 is mixed with fresh toner supplied thereto and then sent again to the supply path 37. Therefore, only sufficiently agitated developer 32 is present in the supply path 37.

The developer that reaches a downstream end portion in the developer conveyance direction in the supply path 37 as well as the developer 32 that has left the developing sleeve 34*a* after passing through the developing range A are transported through the recovery path 38 and then sent to an upstream end portion of the supply path 37. The developer 32 in the recovery path 38 includes the developer 32 whose toner concentration is decreased while it passes through the development range A.

Therefore, supply of a fresh toner to the developer is required. The fresh toner is supplied to the recovery path 38 according to toner consumption calculated based on data of latent images or a detected toner concentration in the recovery path 38. Thus, the developer 32 having a proper toner concentration can be supplied to the supply path 37.

Figure 3:
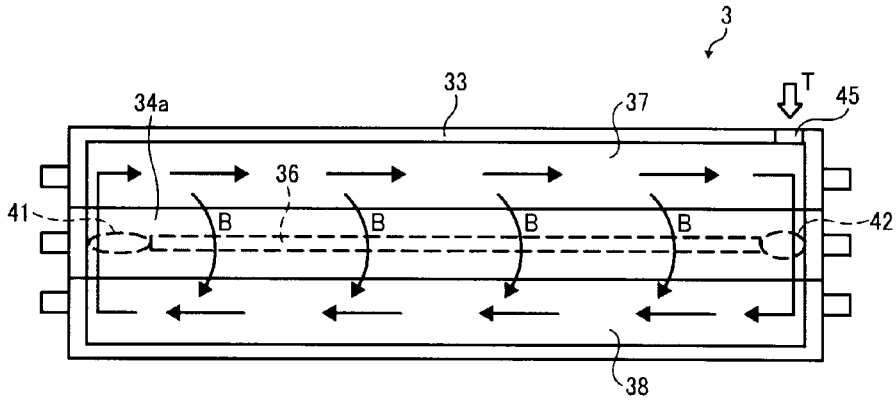
FIG. 3 illustrates a flow of developer in a developer container of the development device shown in FIG. 2.
Figure 4:
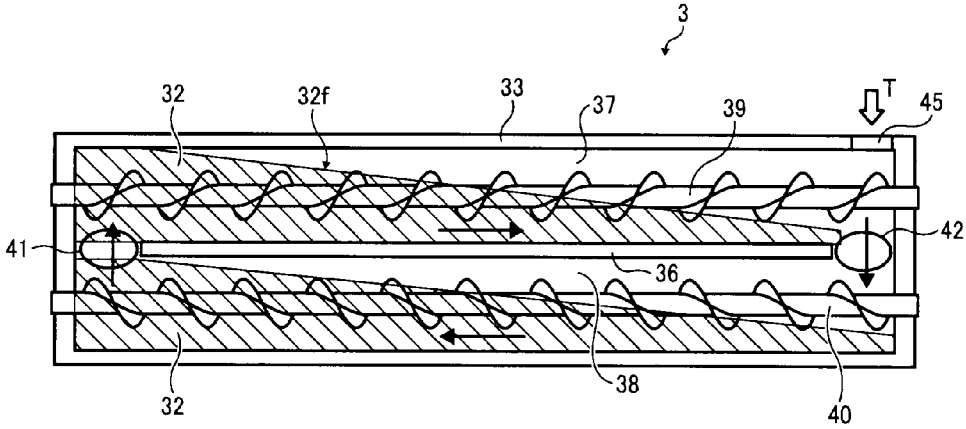
FIG. 4 is a cross-sectional view illustrating the developer container shown in FIG. 3.

FIG. 3 illustrates a flow of the developer 32 in the developer container 33 viewed in the direction indicated by arrow C in FIG. 2. FIG. 4 is a cross-sectional view illustrating the supply screw 39 and the recovery screw 40 viewed in the direction indicated by the arrow C in FIG. 2. In FIGS. 3 and 4, arrows indicate the flow of the developer 32 in the development device 3.

It is to be noted that the paddle member 31 and the developer retaining space 34*c* are omitted in FIGS. 3 and 4.

As shown in FIGS. 3 and 4, because the supply path 37 and the recovery path 38 are arranged vertically, the developer 32 flows down through an opening 42 (hereinafter also "falling hole 42") disposed on the right in the drawings, connecting the downstream end portion of the supply path 37 to the upstream end portion of the recovery path 38 in the developer transport direction. By contrast, the developer 32 is brought up through an opening 41 (hereinafter also "bring-up hole 41") disposed on the left in the drawings, connecting the downstream end portion of the recovery path 38 to the upstream end portion of the supply path 37 in the developer transport direction. The falling hole 42 and the bring-up hole 41 are formed on both ends of the partition 36.

The developer 32 is pumped up by the pressure of the developer 32 accumulated in the downstream end portion of the recovery path 38 through the bring-up hole 41 to the supply path 37. Thus, the developer 32 circulates between the supply path 37 and the recovery path 38 through the falling hole 42 and the bring-up hole 41.

Additionally, fresh toner is supplied by a toner supply unit, not shown, to the development device 3 through a toner supply hole 45 formed in an upper portion of the developer container 33 as shown in arrow T shown in FIGS. 3 and 4.

Then, the toner thus supplied falls into the extreme upstream portion in the toner conveyance direction in the recovery path 38, and thus the toner is supplied to the developer 32 in the developer container 33.Not all of the developer 32 sent from the recovery path 38 to the supply path 37 reaches the downstream end of the supply path 37 in the developer transport direction of the supply screw 39.

As indicated by arrows B shown in FIG. 3, a certain amount of the developer 32 is supplied to the developing sleeve 34*a* in mid-course of transportation in the supply path 37, passes through the developing range A, and then collected in the recovery path 38. Thus, the developer 32 can be supplied onto the circumferential surface of the developing sleeve 34*a* across a substantially entire axial length of the developing sleeve 34*a*. Therefore, the amount of the developer 32 transported by the supply screw 39 in the supply path 37 decreases gradually as the developer 32 flows downstream in the supply path 37. By contrast, as the developer 32 flows downstream in the recovery path 38, the amount of the developer 32 transported by the recovery screw 40 in the recovery path 38 increases gradually.

Thus, dispersion of the developer 32 becomes uneven in the development device 3.

If the developer supplied from a supply path to a developing sleeve that has passed the developing range is directly sent back to the supply path, the amount of the developer in the supply path can be kept constant. This type is hereinafter referred as a bidirectional circulating development device.

However, in this configuration, because the developer whose toner concentration (the content of the toner in the developer) has decreased by consuming the toner of the developer in the developing range is mixed with the developer in the supply path, as the developer flows downstream in the supply path, toner concentration of the developer gradually decreases, which is a problem. More specifically, when the toner concentration of the developer decreases as the developer flows downstream in the supply path, the toner concentration of the developer to be supplied to the developing sleeve fluctuates in an axis direction of the developing sleeve. Accordingly, density of formed image becomes uneven, and therefore, the image quality is degraded.

In addition, in such a development device, in which the developer after passing through the developing range is sent from the developing sleeve to the supply path, when a document whose printing ratio is higher is printed, a greater amount of toner is consumed. Accordingly, unevenness of dispersion of the toner concentration of the developer is more significant, and therefore, the image density in a single sheet or between sheets might become uneven.

By contrast, in so-called "unidirectional circulating development devices", the developer supplied from a supply path that is not supplied to the photoreceptor 1 but remains on the developing sleeve after passing through a developing range is collected in the recovery path instead of being transported to the supply path immediately as the developing sleeve rotates. In a recovery path, the collected developer is mixed with fresh toner supplied thereto and then again sent to the supply path.

Therefore, the fluctuation of the toner concentration in the supply path can be prevented, and the developer having uniform toner concentration is supplied to the developing sleeve. Accordingly, unlike the above-described "bidirectional circulating development device", the toner concentration does not decrease as the developer flows downstream in the supply path.

Therefore, the developer whose toner concentration is uniform is supplied to the developing sleeve, and desirable images that do not include the image density unevenness in sheet width direction caused by insufficiently agitation can be achieved.

The unidirectional circulating development device such as the development device 3 shown in FIG. 2 can prevent the fluctuation of the toner concentration in the supply path, and therefore unevenness in the image density can be prevented even when the document whose printing ratio is high is printed.

It is to be noted that, in the unidirectional circulating development device, the developer supplied from supply path remaining on the developing sleeve after passing through the developing range is not directly collected by the supply path, but collected by the recovery path. Therefore, the toner concentration does not decrease as the developer 32 flows downstream in supply paths in the unidirectional circulating development device.

There are two types of unidirectional circulating development device, "pumped-up type," and "fall by gravity type".

Herein, in a comparative example 1 as a pumped-up type unidirectional circulating development device, a developing sleeve is disposed above a supply path, and the developer in the supply path is pumped up to the developing sleeve due to a magnetic force from a magnet roller provided in the developing sleeve. However, in this example, because the developer is pumped up due to only a magnetic force from a magnet roller provided in the developing sleeve, the developer receives stress, degrading the developer.

By contrast, in falling by gravity type unidirectional circulating development devices, an upper end of the wall that separates the area including the developing sleeve from the supply path is positioned higher than the developing sleeve, and accordingly, the magnetic force to attract the developer becomes lower, and deterioration of developer can be decreased dramatically.

Next, as a comparative example 2, a falling by gravity type unidirectional circulating development device that does not include the paddle member 31 shown in FIG. 2 is described below.

Figure 5:
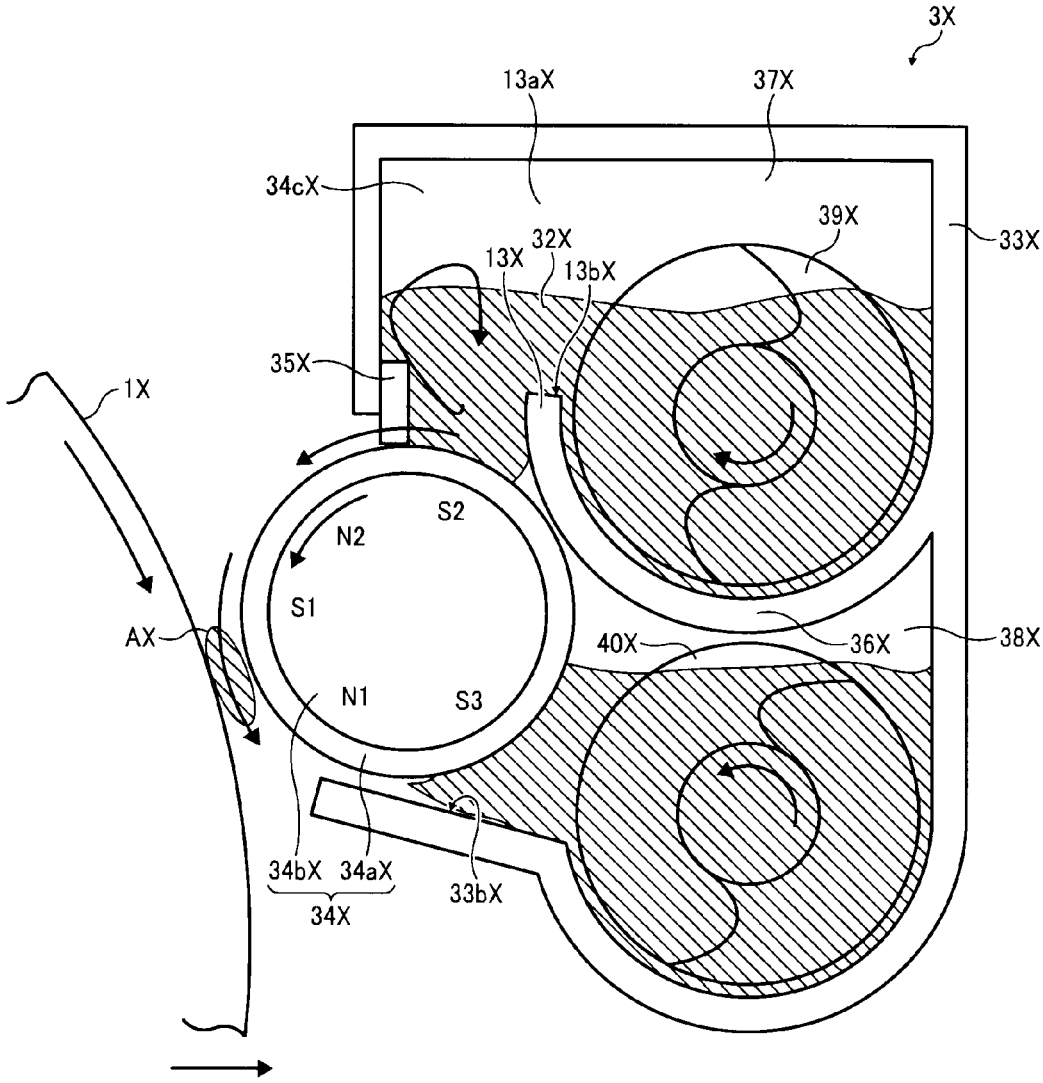
FIG. 5 is a schematic diagram illustrating a configuration of a development device according to a comparative example.

FIG. 5 is a schematic diagram illustrating a configuration of a development device 3X according to the comparative example 2.

One difference between the development device 3X shown in FIG. 5 and the development device 3 shown in FIG. 2 is that the development device 3X does not have the paddle member 31. Another difference between the development device 3X and the development device 3 is that, although the magnet roller 34*b* in the development device 3 shown in FIG. 2 includes three magnetic poles (two negative magnetic poles N1 and N2 and one positive magnetic pole S1), a magnet roller 34*b*X in the development device 3X shown in FIG. 5 includes five magnetic poles (two negative magnetic poles N1 and N2 and three positive magnetic poles S1, S2 and S3). However, the development device 3 according to the aspect of this disclosure can also adopt a magnet roller including five magnetic poles. It is to be noted that, although a suffix X is added to the reference character of each component of the development device X shown in FIG. 5, they have similar configurations to those shown in FIG. 2 unless described otherwise, and thus descriptions thereof are omitted.

In the development device 3X shown in FIG. 5, a communication pathway 13*a*X through which the developer 32X passes when the developer 32X is supplied to a developing sleeve 34*a*X is defined by an upper end 13*b*X of a wall portion 13X and the interior wall of a developer container 33X, similarly to the development device 3 shown in FIG. 2.

The developer 32X stored in a supply path 37X is conveyed by rotation of a supply screw 39X to be supplied to the surface of the developing sleeve 34*a*X via the communication pathway 13*a*X and a developer retaining space 34*c*X.

Supplying the developer 32X from the supply path 37X to the developing sleeve 34*a*X is performed by passing the developer 32X over an upper end 13*b*X of a wall portion 13X positioned between the supply screw 39X and the developing sleeve 34*a*X, and attracting the developer 32X to the developing sleeve 34*a*X due to a magnetic force from the magnet roller 34*b*X provided in the developing sleeve 34*a*X.

As described above, in unidirectional circulating development devices such as the development device 3 shown in FIG. 2, the development device 3X shown in FIG. 5 and the above-described pumped-up type unidirectional circulating development device, the amount of the developer 32X decreases gradually as the developer flows downstream in the supply path 37X, and the developer 32X gradually increases gradually as the developer flows downstream in the recovery path 38X. Therefore, the dispersion of the amount of the developer 32X is uneven in the development devices 3 and 3X.

As a comparative example 2-1, a development device 3X-1 that is one variation of the development device 3X shown in FIG. 5 is described below with reference to FIGS. 6A and 6B.

Figure 6A:
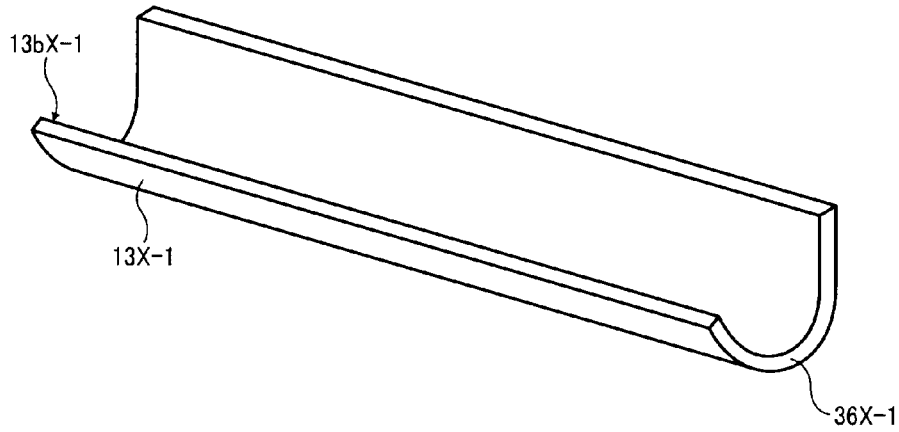
FIG. 6A is a perspective view illustrating a wall portion in a partition 1 whose upper end is flat in a supply path in the development device shown in FIG. 5 according to a first comparative example.

FIG. 6A is a perspective view illustrating the wall portion 13X-1 in the partition 36X-1 in the development device 3X-1. FIG. 6B is a diagram illustrating a relation between height of the wall portion 13X-1 in the development device 3X-1 and level of the developer 32X in a supply path 37X-1. In the development device 3X-1, the height of the upper end 13*b*X-1 of the wall portion 13X-1 is flat.

Movement of the developer 32X in a partition 36X-1 and a wall portion 13X-1 in a development device 3X-1 is described below.

As described above, because the developer 32X supplied from the supply path 37X-1 to a developing sleeve 34*a*X is conveyed to the recovery path 38X, the developer 32X is not conveyed from the developing sleeve 34*a*X to the supply path 37X-1. Therefore, the amount of the developer 32X supplied by the supply screw 39X in the supply path 37X-1 tends to decrease gradually as the developer 32X flows downstream in supply path 37X-1. That is, the dispersion of the amount of the developer 32X becomes uneven in the supply path 37X-1. More specifically, the level of the developer 32X (position of a developer face 32*f*X-1) becomes progressively higher as the amount of the developer increases on the upstream side in the developer conveyance direction, and the level (developer face 32*f*X-1) of the developer 32X becomes progressively lower as the developer 32X flows downstream.

Figure 6B:
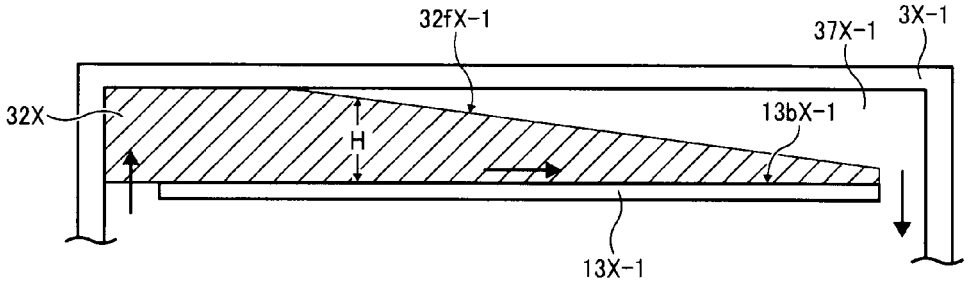
FIG. 6B is a diagram illustrating a relation between the height of the wall portion shown in FIG. 6A and level of the developer in the supply path.

As in this example, although the height of the upper end 13*b*X-1 of the wall portion 13X-1 is similar or identical over its entire longitudinal length as shown in FIG. 6A, the level 32*f*X-1 of developer 32X in the supply path 37X-1 declines as the developer 32X flows downstream shown in FIG. 6B as described above. Therefore, as shown in FIG. 6B, difference in height H between the upper end 13*b*X-1 of the wall portion 13X-1 and the level 32*f*X-1 of the developer 32X becomes progressively larger in the upstream portion in the developer conveyance direction becomes smaller as developer 32X flows downstream.

In the development device 3X-1, because the developer 32X after passing over the wall portion 13X-1 is supplied to the developing sleeve 34*a*X, the amount of the developer 32X supplied to the developing sleeve 34*a*X is larger on the upstream side in the developer conveyance direction, therefore, the fluctuation in supply amount of the developer 32X to the developing sleeve 34*a*X may occur.

When the amount of the developer supplied to the developing sleeve 34*a*X is uneven between the upstream side and the downstream side in the developer conveyance direction in the supply path 37X-1, the amount of the developer 32X borne on the developing sleeve 34*a*X becomes uneven in the axis direction of the developing sleeve 34*a*X. At this time, the amount of the developer 32X supplied to a portion just upstream from the developer regulator 35X that controls the amount of the developer 32X conveyed toward the developing range A in the developing sleeve 34*a* may fluctuate in the axis direction of the developing sleeve 34*a*X.

Additionally, because the magnet roller 34*b*X provided inside the developing sleeve 34*a*X and the developer 32X attract each other, the load therebetween exerted on the developing sleeve 34*a*X is generated. At this time, when the amount of the developer 32X supplied to the portion just upstream from the developer regulator 35X becomes uneven in the axis direction of the developing sleeve 34*a*X, in a portion where the amount of the developer is greater, the force of the developer 32X present in a doctor gap (restriction portion) between the developer regulator 35X and the surface of the developing sleeve 34*a*X presses against the developing sleeve 34*a*X in the direction opposite the side of the developer regulator 35X at the doctor gap, widening the doctor gap and deforming the developing sleeve 34X.

Accordingly, because the developing sleeve 34*a*X deforms, the doctor gap (distance) between the developing sleeve 34*a*X and the developer regulator 35X may fluctuate. When the doctor gap therebetween fluctuates, a greater amount of developer 32X passes through the doctor gap in a portion where the doctor gap is wide, and therefore, the developer 32X conveyed to the developing range A after passing under the developer regulator 35X becomes uneven. When the amount of the developer conveyed to the developing range A fluctuates, image density may become uneven, even though the toner concentration of the developer 32X is uniform in the axis direction of the developing sleeve 34*a*.

Additionally, when the developing sleeve 34*a*X deforms, a developing gap that is a distance between the surface of developing sleeve 34*a*X and the surface of the photoreceptor 1X may become uneven in the axis direction of the developing sleeve 34*a*X. When the developing gap becomes uneven, strength of developing electric field formed between the developing sleeve 34*a*X and the photoreceptor 1 becomes uneven, and the image may become uneven.

Moreover, in the upstream portion where the height difference H in the supply path 37X-1 is greater in the developer conveyance direction, the developer tends to be supplied excessively to the developing sleeve 34*a*X. By contrast, in the downstream portion in the developer conveyance direction in the supply path 37X-1, and the amount of the developer supplied to the developing sleeve 34*a*X may in insufficient because the developer 32X is excessively supplied to the developing sleeve 34*a*X in the upstream portion.

Figure 7A:
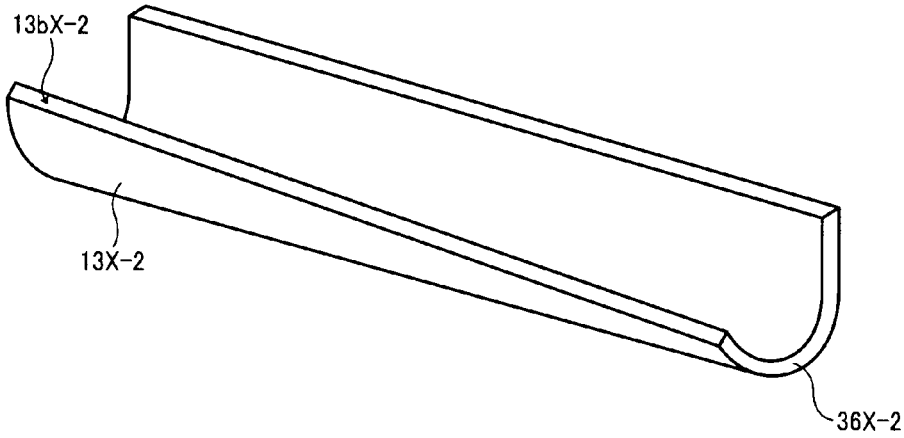
FIG. 7A is a perspective view illustrating a wall portion in another partition whose upper end is progressively higher on the upstream side in a developer conveyance direction in a supply path of the development device shown in FIG. 5 according to a second comparative example.
Figure 7B:
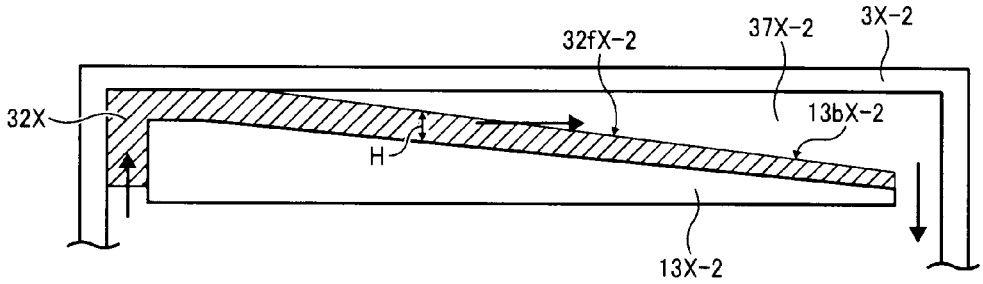
FIG. 7B is a diagram illustrating a relation between the height of the wall portion shown in FIG. 7A and level of developer in the supply path.

This problem can be alleviated in a development device 3X-2, shown in FIGS. 7A and 7B, according to comparative example 2-2 that is another variation of the falling by gravity type unidirectional circulating development device 3X shown in FIG. 5. In the development device 3X-2, the height of an upper end 13*b*X-2 of a wall portion 13X-2 increases gradually toward the upstream side in a supply path 37X-2. The configuration of this comparative example 2-2 is described with reference to FIGS. 7A and 7B. FIG. 7A is a perspective view illustrating a partition 36X-2 forming the wall portion 13X-2 of the development device 3X-2. FIG. 7B is a diagram illustrating a relation between height of the wall portion 13X-2 in the development device 3X-2 and level of the developer 32X in the supply path 37X-2.

Similarly to the development device 3X shown in FIGS. 5 through 7B, the dispersion of the amount of the developer 32X becomes uneven in the supply path 37X-2, and the level of the developer 32X (developer face 32*f*X-2) is higher on upstream side in the developer conveyance direction in the supply path 37X-2, that is, a portion where the amount of the developer 32 is greater. By contrast, the level of the developer 32X (developer face 32*f*X-2) becomes progressively lower as the developer 32X flows downstream.

However, in the development device 3X-2, as shown in FIG. 7A, the height of the upper end 13*b*X-2 of the wall portion 13X-2 is progressively higher in the upstream side in the developer conveyance direction in the supply path 37X-2. Namely, the upper end 13*b*X-2 of the wall portion 13X-2 inclines so that the height of the upper end 13*b*X-2 is degreases gradually toward the downstream side in the supply path 37X-2.

Therefore, because the upper end 13*b*X-2 of the wall portion 13X-2 inclines in the developer conveyance direction, deviation of the difference H between the level 32*f*X-2 of the developer 32X and the height of the upper end 13*b*X-2 in the developer conveyance direction can be reduced dramatically. Accordingly, the uneven dispersion of the developer 32X supplied to the developing sleeve 34*a* after passing over the wall portion 13X-2 can be eliminated.

As described above, similar to the development device 3X (including the development device 3X-1) shown in FIG. 5, in the development device 3X-2, because the supply screw 39X is positioned above the developing sleeve 34*a*X, the developer 32X is supplied from the supply path 37X to the developing sleeve 34*a*X under its own weight to the surface of the developing sleeve 34*a* after passing over the wall portion 13, as the supply screw 39X rotates.

At this time, because the upper end 13*b*X of the wall portion 13X is positioned beneath the developer 32X present in a commutation pathway 13*a*X, the force to move actively the developer 32X is hardly exerted on the developer 32X passing through the communication pathway 13*a*X.

Figure 8A:
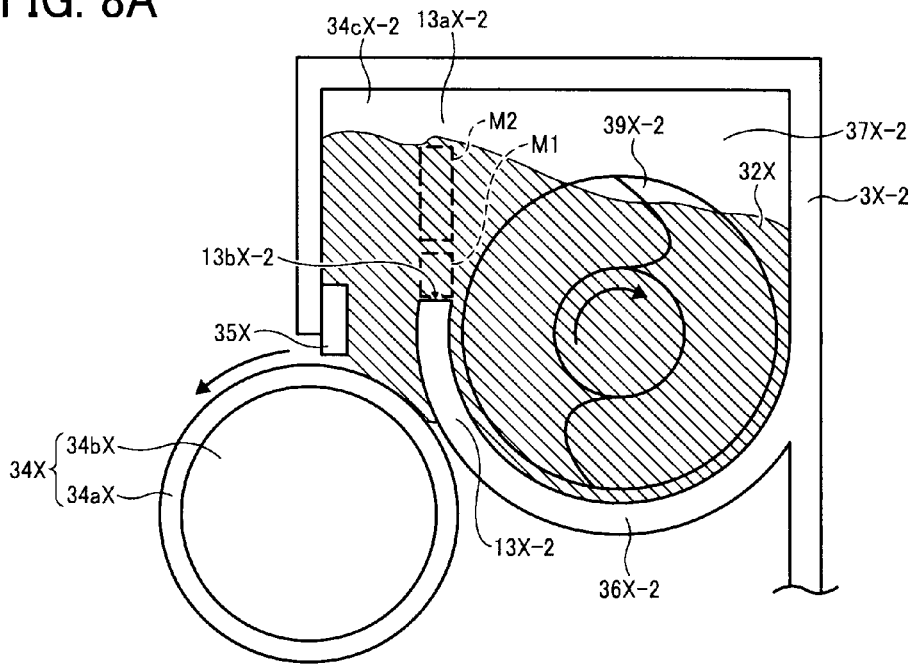
FIG. 8A is an enlarged view illustrating the supply path shown in FIG. 7A, a developer retaining space, and a development roller and illustrates the developer in an upstream portion in the developer conveyance direction in the development device when the amount of the developer is greater in a developer container including the supply path.
Figure 8B:
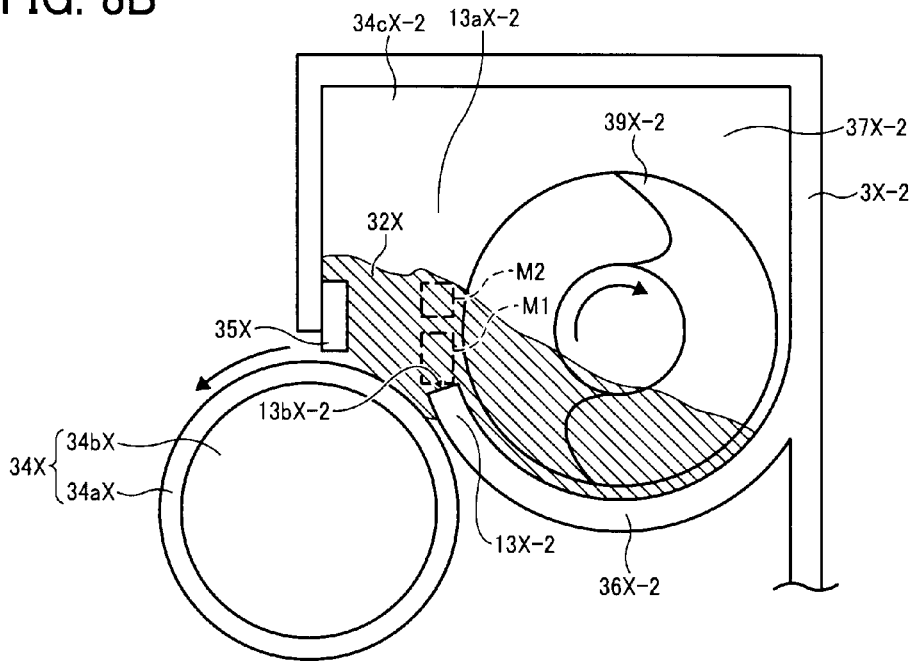
FIG. 8B is an enlarged view illustrating the supply path shown in FIG. 7A, a developer retaining space, and a development roller and illustrates the developer 32X in downstream portion in the developer conveyance direction of the in the development device when the amount of developer is fewer in the developer container.

In addition, with reference to FIGS. 8A and 8B, the developer 32X located in a lower region M1 in the communication pathway 13*a* is easily compressed by pressure from the developer 32X located in an upper region M2. Further, as compared to the developer 32X located in the upper region M2, the developer 32X located in the lower region M1 is surrounded by a larger amount of developer 32X, and the space required for the developer 32X to move from the lower region M1 to the other area is reduced. As a result, the developer 32X tends to remain in the lower region M1 and the developer 32X is easily compressed in the lower region M1.

In view of the foregoing, when the development device 3X is used for a long time, because the developer 32X located in the lower region M1 is gradually compressed, the developer accumulates above the upper end 13*b*X of the wall portion 13X.

FIGS. 8A and 8B are enlarged diagrams of the supply path 37X, the developer retaining space 34*c*X, and the development roller 34X in the development device 3X (including the development devices 3X-1 and 3X-2) shown in FIG. 5. FIG. 8A illustrates the developer 32X in the upstream portion in the supply path 37X in the developer conveyance direction in the development device 3X-2 when the amount of the developer is greater in a developer container 33X. FIG. 8B illustrates the developer 32X in the downstream portion in the developer conveyance direction of the in the development device 3X when the amount of developer in the developer container 33X has declined.

As shown in FIGS. 8A and 8B, the amount of the developer 32X at the upstream end is greater than the amount of the developer 32X at the downstream end in the communication pathway 13*a*X, and the developer 32X located in the lower region M2 is compressed gradually due to its own weight (by the pressure exerted from the developer located in the upper region M2), and can accumulate easily.

Accordingly, because the accumulated developer 32X located above the upper end 13*b*X of the wall portion 13X becomes a barrier (agglomeration wall) for conveying developer, the height of the wall portion 13X and the agglomeration wall increases as the agglomeration grows. Then, when the top of agglomeration wall on the upper end 13*b*X of the wall portion 13X becomes higher than the level 32*f*X at which the developer 32X can reach in the supply path 37X, the developer 32X cannot pass over the wall portion 13X and the agglomeration wall. Accordingly, the developer cannot be supplied to the developing sleeve 34*a*X, and the image formation cannot be performed.

Further, although the height of the wall portion 13X and the agglomeration wall is not greater than the level 32*f*X at which that developer 32X can reach, the supply amount of the developer 32X to the developing sleeve 34*a*X decreases in a portion where the agglomeration is formed, which causes faded images due to the insufficient supply of the developer 32X to the developing sleeve 34*a*X.

In addition, when the agglomeration is formed close to the wall portion 13X and the development device 3X is vibrated greatly, for example, by moving the printer 100X (for example), the agglomeration breaks up, and the loose agglomeration might clog the doctor gap formed between the developer regulator 35X and the developing sleeve 34*a*X. Accordingly, image failure, (e.g., white line in the image) may be caused.

In order to solve these image failures, the development device according to an illustrative embodiment includes a developer softening member that softens the developer provided in a portion where the developer accumulates easily.

Therefore, even when the printer is used for a long time, the developer can be supplied reliably, preventing the agglomeration of the developer.

Next, one distinctive feature of the development device 3 according to the aspect of this disclosure is described below with reference to FIG. 2. As shown in FIG. 2, the development device 3 includes the paddle member 31 that includes a rotary shaft 31*a* and a fin 31*b*, and which functions as a developer softening member that softens the developer 32 located above the upper end 13*f* of the wall portion 13.

In this embodiment, the paddle member 31 is driven and rotated by a driving source (not shown), fins of the paddle member 31 move above the wall portion 13, and therefore, the paddle member 31 can soften the developer staying close to the upper end 13*b* of the wall portion 13. Therefore, even when the printer 100 is used for a long time, the developer can be prevented from coagulating.

Next, the shape of the fins of the paddle member 31 is described with reference to FIGS. 9A through 11B. With reference to FIG. 9A through 11B, the paddle member 31 rotates in a direction indicated by arrow D shown in FIG. 2 by transmitting a driving force from the driving source (not shown), which softens the developer 32.

More specifically, an axis of the rotary shaft 31*a* of the paddle member 31 is extended parallel to an axis of the supply screw 39, and the paddle member 31 is rotated in the direction indicated by the arrow D so that the fin 31*b* located beneath the rotary shaft 31*a* moves the developer from the developer retaining space 34*c* to the supply path 37.

By contrast, if the paddle member 31 is rotated in a direction opposite to the direction indicated by the arrow D, the force that conveys the developer 32 from the supply path 37 to the developer retaining space 34*c* is exerted on the developer 32 located beneath the rotary shaft 31*a*. In the configuration having the function that this conveyance force is applied to the developer 32, the conveyance force exerted on the developer 32 from the supply path 37 to the developer retaining space 34*c* changes depending whether or not the paddle member 31*b* is positioned beneath the rotary shaft 31*a*. Therefore, the amount of the developer supplied to the developing sleeve 34*a* fluctuates, and unevenness in the image density occurs in the image.

Figure 9A:
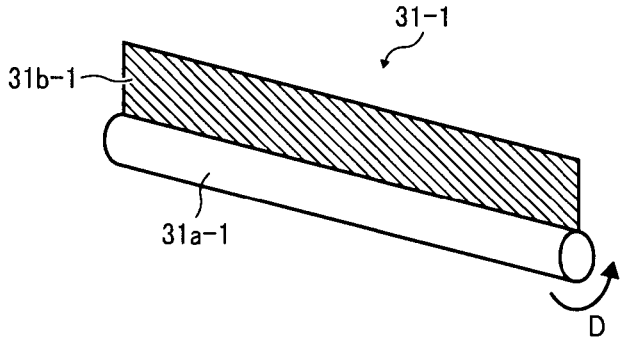
FIG. 9A is a perspective view illustrating a paddle member including a bladed fin, provided in the development device shown in FIG. 2.
Figure 10A:
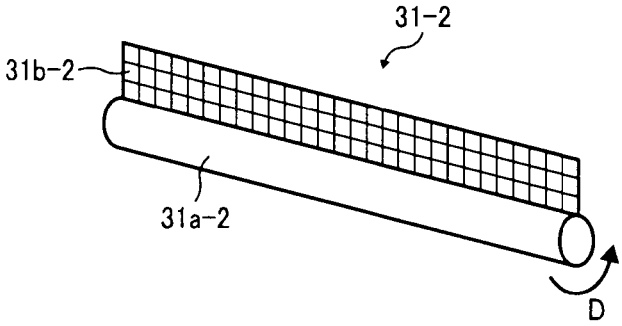
FIG. 10A is a perspective view illustrating a paddle member including a mesh shaped fin, provided in the development device shown in FIG. 2.
Figure 11A:
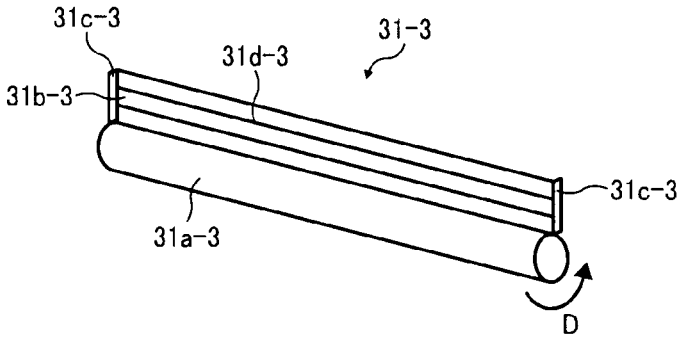
FIG. 11A is a perspective view illustrating a paddle member including a wired shaped fin, provided in the development device shown in FIG. 2.

In order to avoid this problem, in the present embodiment, the paddle member 31 is rotated in the direction indicated by arrows D shown in FIG. 9A, 10A, and 11A to diminish the unevenness in the conveyance force and the unevenness in the image density.

It is to be noted that, although a rotary member as a developer softening member is not limited to the paddle shape and instead can be a roller member or a wire bending member, the paddle member 31 is more effective than other shapes because the paddle member 31 includes the fin 31*b* that softens the developer by rotating around the rotary shaft 31*a*. Various shapes of the fin are described below.

Figure 9B:
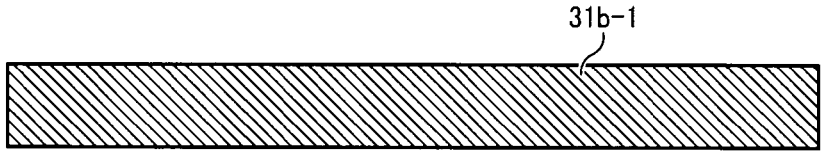
FIG. 9B is a front view illustrating the paddle member shown in FIG. 9A.

FIGS. 9A and 9B illustrate structures of a paddle member 31-1 using a fin 31*b*-1 according to a first variation of the first embodiment. FIG. 9A is a perspective view illustrating the paddle member 31-1. FIG. 9B is a front view illustrating the paddle member 31-1. In this configuration, the fin 31*b*-1 is formed of a plate blade.

Figure 10B:
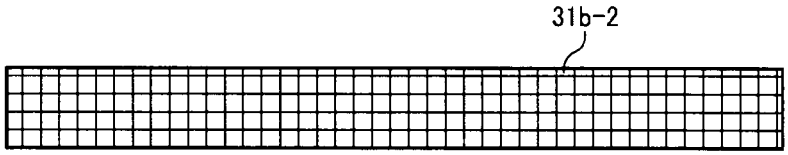
FIG. 10B is a front view illustrating the paddle member shown in FIG. 10A.

FIGS. 10A and 10B illustrate structures of a paddle member 31-2 using a fin 31*b*-2 according to a second variation of the first embodiment. FIG. 10A is a schematic diagram illustrating the paddle member 31-2. FIG. 10B is a front view illustrating the paddle member 31-2. In this configuration, the fin 31*b*-2 is formed of mesh shape.

Figure 11B:
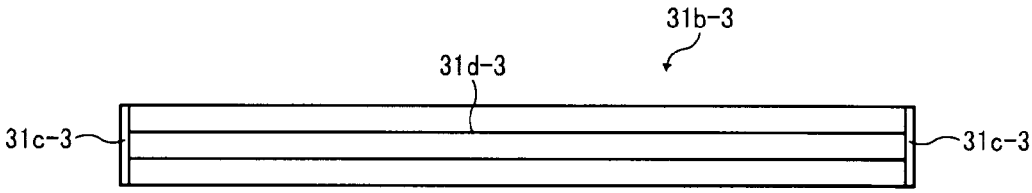
FIG. 11B is a front view illustrating the paddle member shown in FIG. 11A.

FIGS. 11A and 11B illustrate structures of a paddle member 31-3 using a fin 31*b*-3 according to a third variation of the first embodiment. FIG. 11A is a schematic diagram illustrating the paddle member 31-3. FIG. 11B is a front view illustrating the paddle member 31-3. In this variation, the fin 31*b*-3 is formed of two support members 31*c* that protrude toward the axis direction of the rotary shaft 31*a* ands multiple linear members 31*d* that are stretched between the two support members 31*c* and are extended perpendicular to an axis of the rotary shaft 31*a*.

With reference to FIG. 9A and 9B, when paddle blade 31*b*-1 that is shaped like a plate blade rotates, the conveyance force exerted on the developer 32 by rotating the paddle member 31-1 is so large that the amount of the developer 32 passing through the communication pathway 13*a* may fluctuate in accordance with the rotational period of the paddle member 31-1.

Therefore, the paddle members 31-2 and 32-3 shown in FIGS. 10A through 11B are more effective because the members 31-2 and 32-3 use the mesh shaped paddle fin 31*b*-2 and the linear typed paddle fin 31*b*-3, and accordingly the paddle members 31-2 and 31-3 have a function to soften the developer 32 by rotating, and the conveyance force to the developer 32 can be inhibited.

That is, it is preferable that the paddle fin 31*b* has at least one through-hole therein, such as the mesh shape shown in FIGS. 10A and 10B and the linear shape shown in FIGS. 11A and 11B. In these configurations, the conveyance force exerted on the developer by moving the paddle fin 31*b* can be inhibited, and generating unevenness of the amount of the developer 32 passing through the communication pathway 13*a* in accordance with the rotation period can be prevented.

Concerning a gap (clearance) between the lower edge of the fin 31*b* of the paddle member 31 and the upper end 13*b* of the wall portion 13, if the fin 31*b* contacts the wall portion 13, the heat is generated in the contact portion therebetween, and therefore, the adhesion (agglomeration) of the developer is caused.

In order to avoid this problem, the gap between tip portion of the paddle fin 31*b* and the upper end 13*b* of the wall portion 13 preferably ranges from about 0.5 mm to about 1.5 mm.

It is to be noted that, in the development device 3 according to the present embodiment, in order to reduce deviation of the amount of the developer 32 supplying to the developing sleeve 34*a* in the developer conveyance direction caused by the bias of the developer 32 in the developer conveyance direction in the supply path 37, the height of the wall portion 13 progressively reduced so that the position of the upper end 13*b* of the wall is progressively higher in upstream side of the developer conveyance and is progressively lower on the downstream side, similar to the comparative example shown in FIGS. 7A and 7B.

Accordingly, in the development device 3, the rotary shaft 31*a* of the paddle member 31 may be in parallel to the upper end 13*b* of the wall portion 13. Alternatively, although the height of the wall portion 13 is progressively higher the farther upstream of the developer conveyance in this embodiment, the development device 3 also can adopt the wall portion 13 whose upper end 13*b* is horizontal, similar to the comparative example shown in FIGS. 6A and 6B.

Second Embodiment

A second embodiment is described below with reference to FIGS. 12 through 13B.

Figure 12:
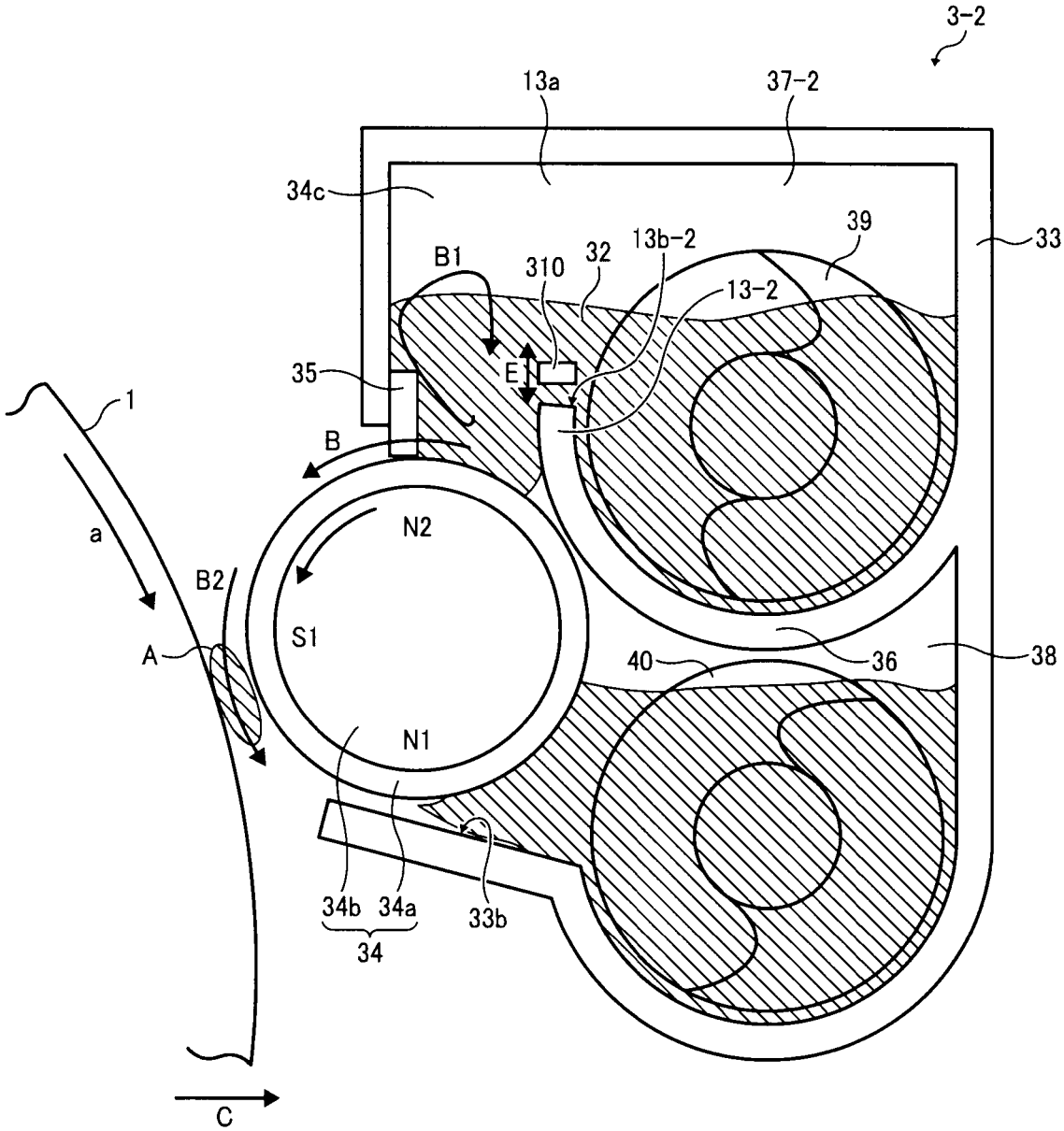
FIG. 12 is a diagram illustrating a development device according to a second illustrative embodiment, installable in the image forming apparatus shown in FIG. 1.

FIG. 12 is a diagram illustrating a development device 3-2 installable in the printer 100, according to the second embodiment.

As shown in FIG. 12, the development device 3-2 includes a vertical vibration member 310 that swings in a direction indicated by arrow E shown in FIG. 12, serving as a developer softening member to soften the developer 32 located over an upper end 13*f*-2 of a wall portion 13-2.

Figure 13A:
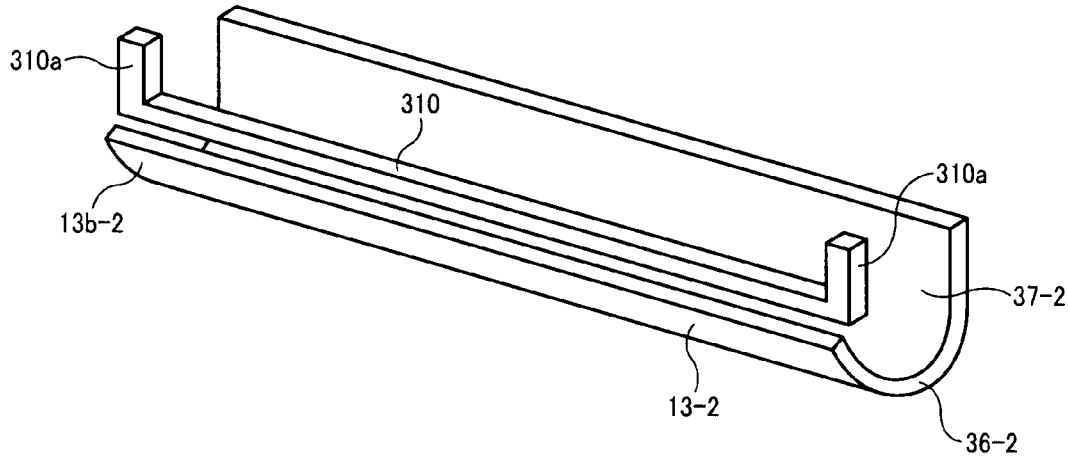
FIG. 13A is a perspective view illustrating a vertical vibration member and a partition forming a supply path in the development device shown in FIG. 12.
Figure 13B:
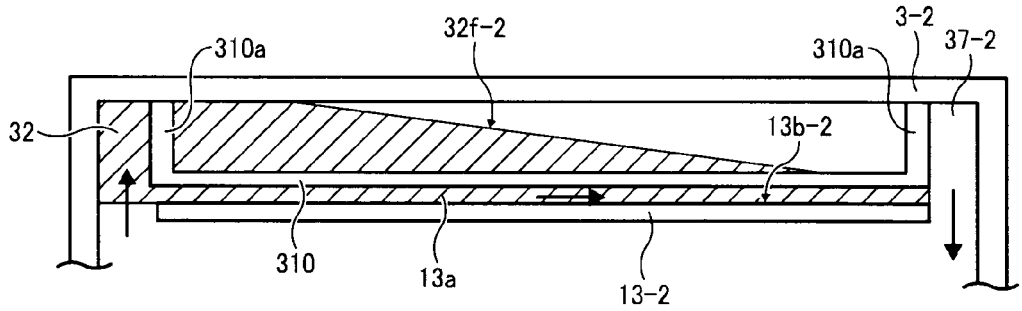
FIG. 13B is a diagram illustrating a relation between arrangement of the vertical vibration member shown in FIG. 13A and level of the developer in the supply path in the development device.

FIGS. 13A and 13B are explanatory diagrams of the supply path 37. FIG. 13A is a schematic diagram illustrating a vertical vibration member and a partition 36 forming a supply path 37-2. FIG. 13B is a diagram illustrating a relation between the arrangement of the vertical vibration member 310 and the level 32*f* of the developer 32 in the supply path 37 on the development device 3-2.

With reference to FIG. 13B, support members 310*a* support both ends in an axis line direction of the vertical vibration member 310. In this configuration, the vertical vibration member 310 is vibrated by driving a solenoid that vibrates vertically provided in the support member 310*a*.

In this development device 3-2 according to the present embodiment, because the vertical vibration member 310 can soften the retaining developer 32 above close to the upper end 13*b*-2 of the wall portion 13-2 by vibrating the vertical vibration member 310 above the wall portion 13. Consequently, the aggregation of the developer 32 can be prevented even when the development device 3 is used for a long time.

It is to be noted that, although the development device 3-2 includes the vertical vibration member 310 that vibrates vertically, the vibration member that softens the developer close to the upper end 13*b*-2 of the wall portion 13-2 can also adopt a horizontal vibration member.

In the development device 3-2 according to the present embodiment, it is not necessary to drive the vertically vibration member 310 every time while images are outputted.

By contrast, the vibration member 310 vibrates after the image outputting, at driving up of the power supply in the printer 100, or when the unit changes, which is more preferable the driving of the vibration member to the image outputting.

Additionally, it is preferable that the shapes of the vibration member be small enough that the vibration member 310 does not block the flow of the developer 32 from the supply path 37-2 to the developer retaining space 34*c* via the communication pathway 13*a*.

Third Embodiment

Figure 14:
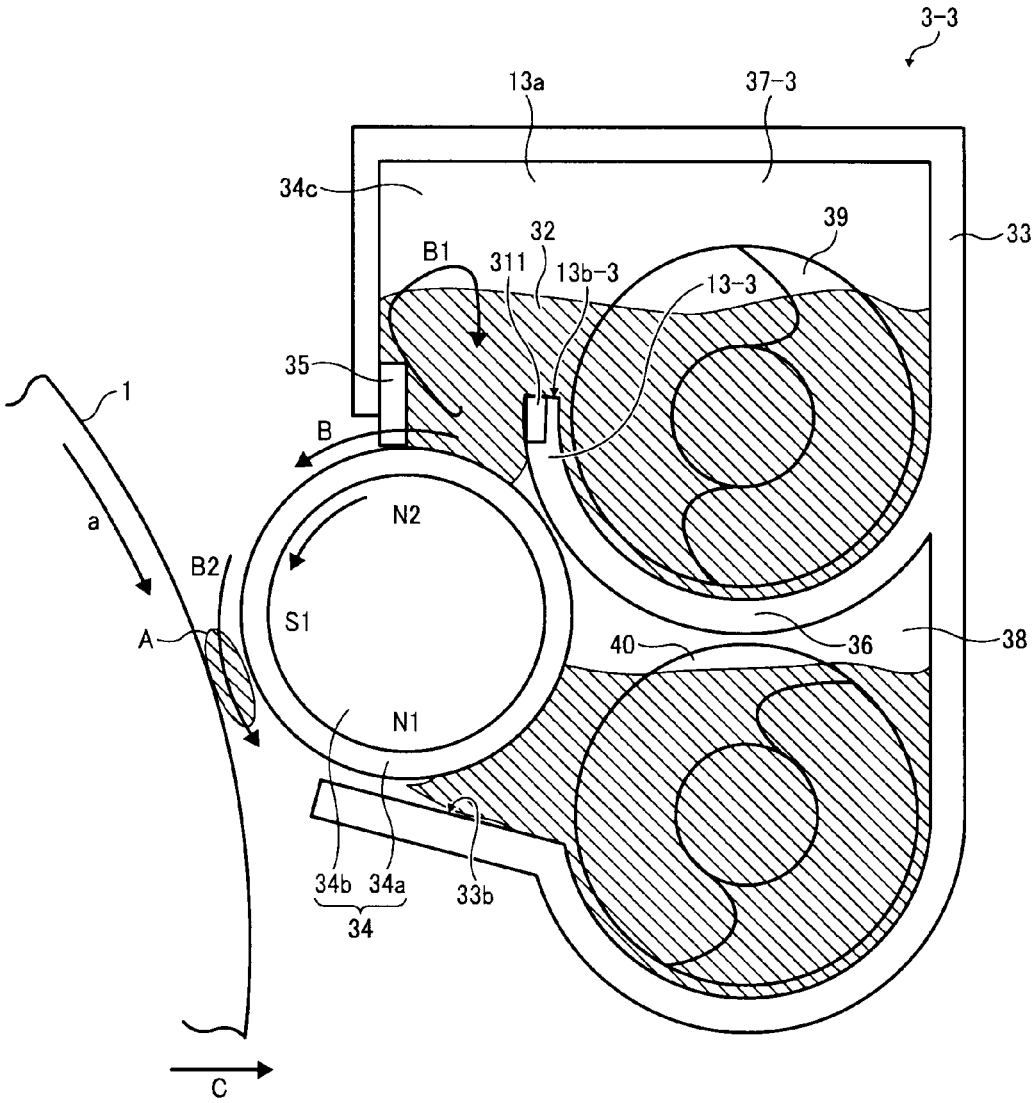
FIG. 14 is a diagram illustrating a development device according to a third illustrative embodiment, installable in the image forming apparatus shown in FIG. 1.

FIG. 14 is a diagram illustrating a development device 3-3 installable in the printer 100, according to a third embodiment.

As shown in FIG. 14, the development device 3-3 includes an oscillation member 311, serving as a developer softening member, which softens the developer 32 located in the upper portion of a wall portion 13-3. The oscillation member 311 is an ultrasonic vibrator.

By oscillating the oscillation member 311, the oscillation is transmitted to the developer 32 retaining close to the upper end 13*b* of the wall portion 13. Therefore, the developer located at the lower side can be softened even when the pressure is exerted from the developer located further upstream, and consequently, accumulation of the developer 32 can be prevented.

Fourth Embodiment

Figure 15:
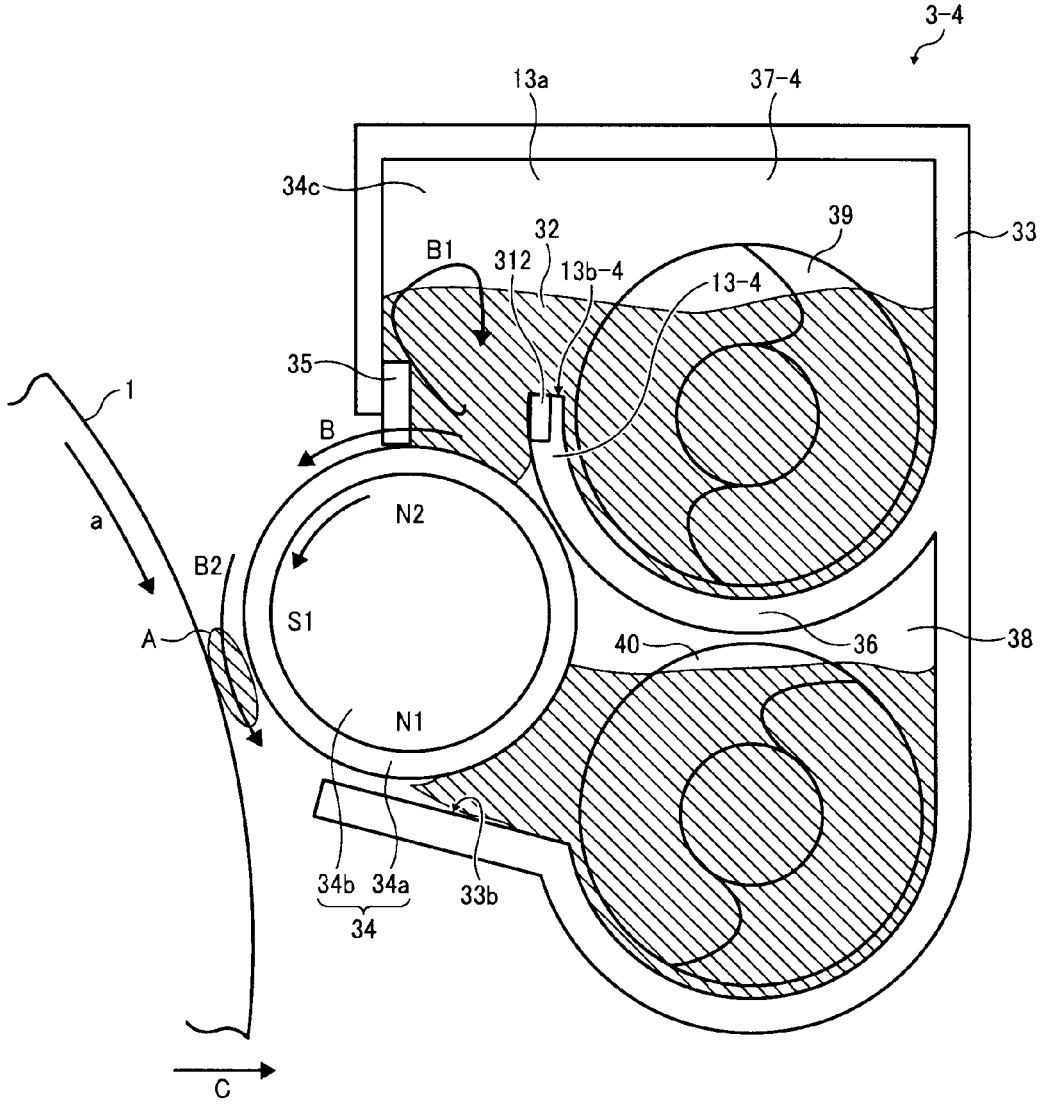
FIG. 15 is a diagram illustrating a development device according to a fourth illustrative embodiment, installable in the image forming apparatus shown in FIG. 1.

FIG. 15 is a diagram illustrating a development device 3-4 installable in the printer 100, according to a fourth embodiment.

As shown in FIG. 15, the development device 3-4 includes an electromagnet 312, serving as a developer softening member, which softens the developer 32 located in the upper portion of a wall portion 13-4. The electromagnet 312 is a magnetic field forming member that forms a magnetic field whose size and direction is changeable close to the communication pathway 13*a*.

The magnetic field generated by the electromagnet 312 causes the developer to stand erect as magnetic ears upward.

If the electromagnet 312 forms the magnetic field while the image is formed, the circulation of the developer 32 may be inhibited. Therefore, it is preferable to send a control signal to the electromagnet 312 after the image is output, and subsequently, the electromagnet 312 forms the magnetic field.

When the electromagnet 312 forms the magnetic field, the developer 32 located around the electric magnet stand erect as magnetic ears in alignment with vectors of the generated magnetic field.

At this time, when the developer 32 located in the upper range M2 presses the developer 32 located in the lower range M1, the developer 32 located in the lower range M1 is moved by the magnetic force of the electric magnet 31 and softened, and therefore, the aggregation of the developer can be prevented.

Next, the shapes of the upper end 13*b* of the wall portion 13 are described below with reference to FIGS. 16A through 16C.

Figure 16A:
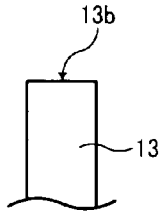
FIG. 16A is an enlarged view illustrating vicinity of a flat upper end of the wall portion in the development device shown in FIG. 2, 12, 14 or 15.
Figure 16B:
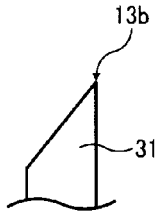
FIG. 16B is an enlarged view illustrating vicinity of a gradient upper end of the wall portion in the development device shown in FIG. 2, 12, 14 or 15.
Figure 16C:
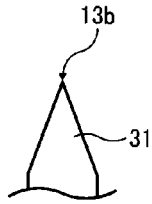
FIG. 16C is an enlarged view illustrating vicinity of a cuneal shaped upper end of the wall portion in the development device shown in FIG. 2, 12, 14 or 15.

FIG. 16A is an enlarged illustrating vicinity of the upper end 13*b* of the wall portion 13 in the first through fourth embodiments, and FIGS. 16B and 16C are enlarged views illustrating vicinity of the upper end 13*b* of walls 13-2 and 13-3 as variations of the wall portion 13.

As show in FIG. 16A, the upper end 13*b* the wall portion 13 in the first embodiment through the fourth embodiment is flat. However, as for the shape of the upper end 13*b* can adopt other configurations, for example, the upper end having a gradient, shown in FIG. 16B, or, the cuneal shape shown in FIG. 16C can be applied.

When the upper end 13*b* is formed to shapes shown in 16B or 16C, the amount of the developer that stays close to the upper end 13*b* of the wall portion 13, 13-2, 13-3, and 13-4 can be less.

It is to be noted that, although the above-described respective development devices according to the first through fourth embodiments include a single developer softening member, alternatively the development device 3 may also include multiple types of developer softening members representing a combination of those described above.

Fifth Embodiment

In the development devices according to the first embodiment to the fourth embodiment, the supply screw 39 is positioned above the developing sleeve 34*a*, and the developer after passing over the wall portion 13 from the supply path 37 is supplied to the developing sleeve 34*a* by the gravity.

In these configurations, because the force to move the developer is less likely to be exerted on the developer in the communication pathway, the agglomeration is easily formed adjacent to the upper end 13*b* of the wall. Therefore, the developer softening member has great effect to prevent the agglomeration of the developer.

Alternatively, the developer softening member can also be applied to the development device in which the developer in the supply path is pumped up due to the magnetic force, similarly to the comparative example 1. In a pumped-up type development device, the magnetic force to move the developer can act even on the developer present in a portion above the wall portion 13, and therefore the developer is less likely to accumulate adjacent to the upper end 13*b* of the wall portion 13. However, in the configuration in which the wall is positioned between the supply path and the developing sleeve and developer is conveyed from the supply path to the development sleeve through the communication pathway above the wall, the developer may accumulate close to the upper end of the wall.

A fifth embodiment, which addresses this problem, is described below with reference to FIG. 17.

Figure 17:
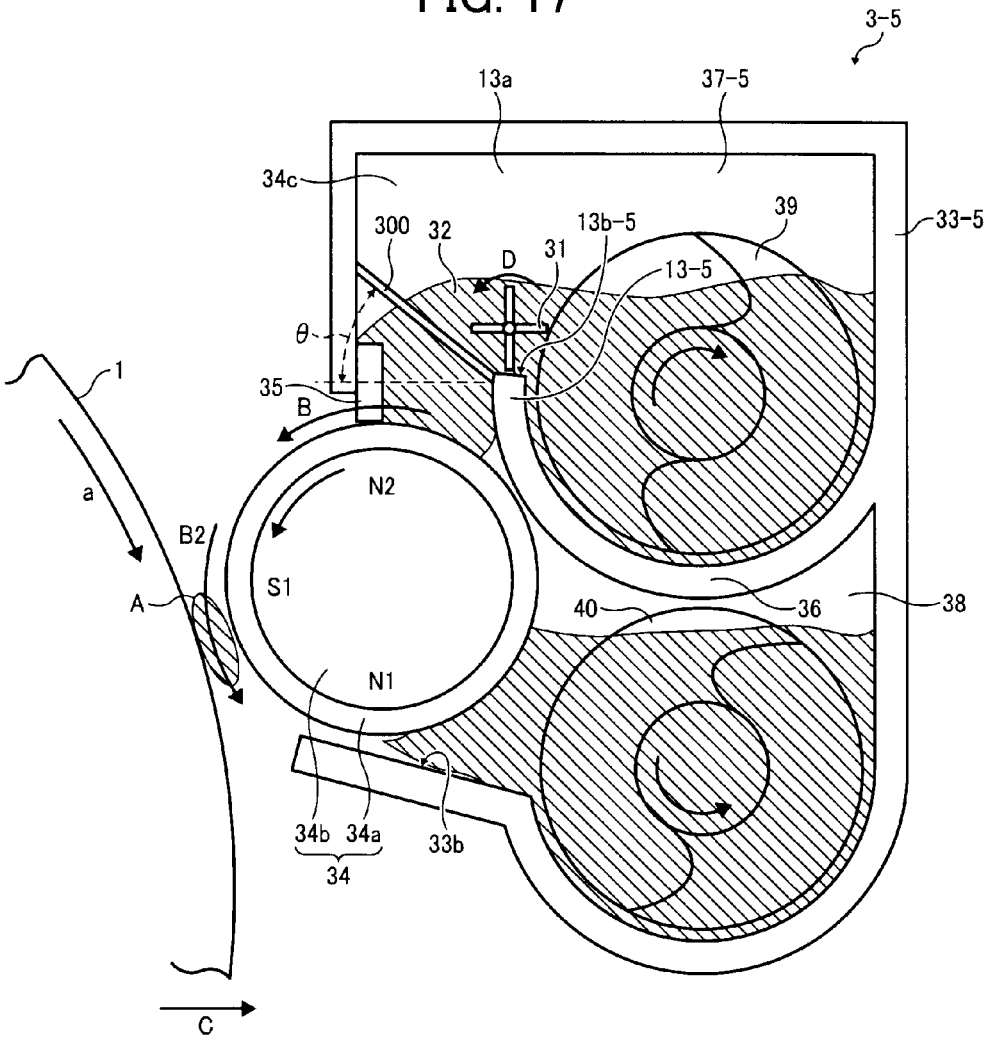
FIG. 17 is a diagram illustrating a development device according to a fifth illustrative embodiment, installable in the image forming apparatus shown in FIG. 1.

FIG. 17 is a diagram illustrating a development device installable in the printer 100, according to the fifth embodiment.

As shown in FIG. 17, the development device 3-5 further includes a foreign object removal member 300 in addition to other components in the development device 3 according to the first embodiment.

In the development device 3 described above, the supply screw 39 is disposed above the developing sleeve 34*a*. In these configurations, when the developer 32 is supplied from the supply path 37 to the developing sleeve 34*a*, the developer 32 after passing over the wall portion 13 falls under its own weight onto the surface of the developing sleeve 34*a* by rotation of the supply screw 39, which can reduce the magnetic force required to attract the developer. Therefore, deterioration of developer can be decreased dramatically.

However, in the fall by gravity type development device, in which developer 32 after passing over the wall portion 13 falls under its own weight to the surface of the developing sleeve 34*a* by rotation of the supply screw 39, when foreign objects and the toner agglomeration are mixed with the developer 32 in the developer container 33, which causes white lines. Further, the development devices shown in FIGS. 2 through 12 is the unidirectional circulating development device, more specifically, the developer 32 supplied from the supply path 37 to the developing sleeve 34*a* is not returned to the supply path 37 but is instead conveyed to the recovery path 38, and then, the developer 32 stored in the recovery path 38 is sent to the supply path 37.

In these unidirectional circulating development devices, as compared with the bidirectional circulating development device in which the developer supplied from the supply path to the developing sleeve is returned to the supply path, once the foreign object is mixed with the developer 32 in the developer container 33, the white line in the image is caused easily.

The mechanism of generation of the white line in the image is described below.

In the development device 3, foreign objects larger than the doctor gap that is a shortest gap between the developer regulator 35 and the developing sleeve 34*a* may enter the developer container 33.

At this time, when the foreign objects that is larger than the doctor gap is supplied to the surface of the developing sleeve 34*a* with the developer 32 and reaches the doctor gap (restriction portion) at which the developer regulator 35 controls the amount of the developer 32 on the surface of the developing sleeve 34*a*, the foreign object clogs the doctor gap between the developing sleeve 34*a* and the developer regulator 35.

When the foreign object clogs the doctor gap, the developer cannot pass through the portion where the foreign object clogs.

Therefore, the developer 32 is not supplied to a portion of the surface of the development sleeve 34*a* downstream in the developer moving direction from the portion where clogging occurs, and the latent image disposed facing to this portion is not developed. Therefore, a white line appears in the image.

Unlike the unidirectional circulating development device, in the bidirectional circulating development device in which the developer supplied from the supply path to the developing sleeve is returned to the supply path, the probability of supply of any given portion of the developer from the supply path to the developing sleeve is not uniform but instead varies. More specifically, while the developer moves through the supply path from the extreme upstream to the extreme downstream, some developer is supplied to the developing sleeve many times, while other developer is not supplied to the developing sleeve but is circulated in the developer container. Accordingly, even if the foreign object enters the developer container in the bidirectional circulating development device, the foreign objects may not be conveyed to the restriction portion at which the developer regulator controls the amount of the developer.

By contrast, in the unidirectional circulating development device, because the developer supplied from the supply path to the developing sleeve is sent to the recovery path, the developer container gradually decreases as the developer flows downstream in the supply path. Therefore, almost all of the developer in the supply path is supplied to the developing sleeve, and is conveyed to the restriction portion at which the developer regulator controls the amount of the developer. Therefore, when the foreign object enters the developer container, in the unidirectional circulating development device, because almost all of the developer in the developer container is supplied to the developing sleeve, the white line is relatively frequently caused.

In addition, in the unidirectional circulating development device, if the development device is not the fall by gravity type development device, in which the supply path is disposed above the developing sleeve and the developer is supplied from the supply path to the developing by the gravity, but is the pumped-up type development device, in which the developing sleeve is disposed above the supply path and the developer is supplied from the supply path to the developing sleeve due to the magnetic force, the developer is borne on the surface developing sleeve by only the magnetic force. Then, because the foreign object that is not a magnetic material does not receive the bearing force from the magnetic force, the foreign object can drop while the developer is pumped up or is conveyed to the developing sleeve, and the foreign object is less likely to be conveyed to the doctor gap.

By contrast, in the falling by gravity type unidirectional circulating development device , because the developer is conveyed from the supply path to the developing sleeve by the gravity, as compared with the pumped-up type unidirectional circulating development device, in which the developer is conveyed by the magnet force, the stress to the developer can be reduced. However, in the falling by gravity type unidirectional circulating development device, because the nonmagnetic foreign objects mixed with the developer is also conveyed from the supply path to the developing sleeve by the gravity, foreign objects are easily conveyed from the supply path to the doctor gap (restriction portion) at which the developer regulator controls the amount of the developer, and white lines in the image may more frequently occur.

In order to better prevent the occurrence of white lines in the images and enhance image quality, the fifth embodiment that includes the foreign object removal member 300 is described below.

As shown in FIG. 17, in the development device 3-5, the foreign object removal member 300 that in the present embodiment is formed of a planar mesh material is disposed above the developer regulator 35 and positioned between the interior wall of the developer container 33-5 and the wall portion 13-5. By thus providing the foreign object removal member 300, only particles smaller than the mesh grid can pass through in the thickness direction the foreign object removal member 300. In this configuration, the developer 32 flowed from the supply path 37-5 passes over the wall portion 13-5 and then inevitably passes through the foreign object removal member 300, after which, the developer 32 reaches the surface of the developing sleeve 32*a*. The developer 32 thus arrived at the developing sleeve 34*a* is conveyed to the doctor gap at which the developer regulator 35 controls the amount of the developer 32 as the developer sleeve 34*a* rotates.

In this configuration, the mesh grid in the foreign object removal member 300 is sized so that the foreign object removal member 300 can remove any foreign object that may clog the doctor gap formed between the developer regulator 35 and the developing sleeve 34*a*. Accordingly, even when the foreign object enters the developer container 33-5, the foreign object is not conveyed to the doctor gap between the developer regulator 35 and the developing sleeve 34*a*, which can prevent the occurrence of white lines in the image and produce high quality images.

As the size of the mesh of the foreign object removal member 300 becomes smaller, the foreign object removal member 300 can more reliably remove the foreign object. However, when the size of the mesh of the foreign object removal member 300 is smaller than a particle diameter of the developer 32, the developer cannot pass through the foreign object removal member 300. In addition, when the size of mesh of the foreign object removal member 300 is close to the size of the particle diameter of the developer 32, clogging can frequently occur while the development device is used for a long time.

Therefore, in order to obtain good circulation of the developer, it is preferable that the mesh of the foreign object removal member 300 be twice to five times the size of the particle diameter of the developer.

As for the particle diameter of the developer, in this specification it is assumed that a toner particle adheres to each side of the carrier particle, and the developer particle size is a sum of the particle size of the carrier and twice the particle size of the toner.

Therefore, in order to remove the foreign object and obtain good developer circulation, it is preferable that the following relation be satisfied:

$$2Td<Md<d$$

where Td indicates a developer particle size, Md indicates size of mesh, and d is the size of the doctor gap formed between the developer regulator 35 and the developing sleeve 34*a*.

Herein, as shown in FIG. 17, the angle between the horizontal face and the foreign object removal member 300 is set to an angle θ. For example, when the foreign object removal member 300 is set so that the angle θ is 0°, the foreign object that is blocked from passing through in the thickness direction of the foreign object removal member 300 cannot move from upper face of the foreign object removal member 300, and the clogging is easily caused.

When the foreign object removal member 300 is set so that the angle θ is equal to or greater than 30°, the foreign object blocked and prevented from passing in the thickness direction of the foreign object removal member 300 and caught in an upper portion of the developer can move along the slanted foreign object removal member 300 and then drops due to gravity. Therefore, in this embodiment, the angle θ is set to equal to or greater than 30° to prevent clogging.

In addition, in the development device 3-5 according to the fifth embodiment, although the foreign object removal member 300 is added to the development device 3 according to the first embodiment, alternatively, the foreign object removal member 300 can be included in the respective development devices 3-2, 3-3, and 3-4 according to the second, third, and fourth embodiments.

Moreover, although this embodiment adopts a planar mesh as the foreign object removal member 300, the material for the foreign object removal member is not limited to the mesh but can be any material that can pass only particles smaller than a certain size.

Sixth Embodiment

A sixth embodiment is described below with reference to FIGS. 18, 19A and 19B.

Figure 18:
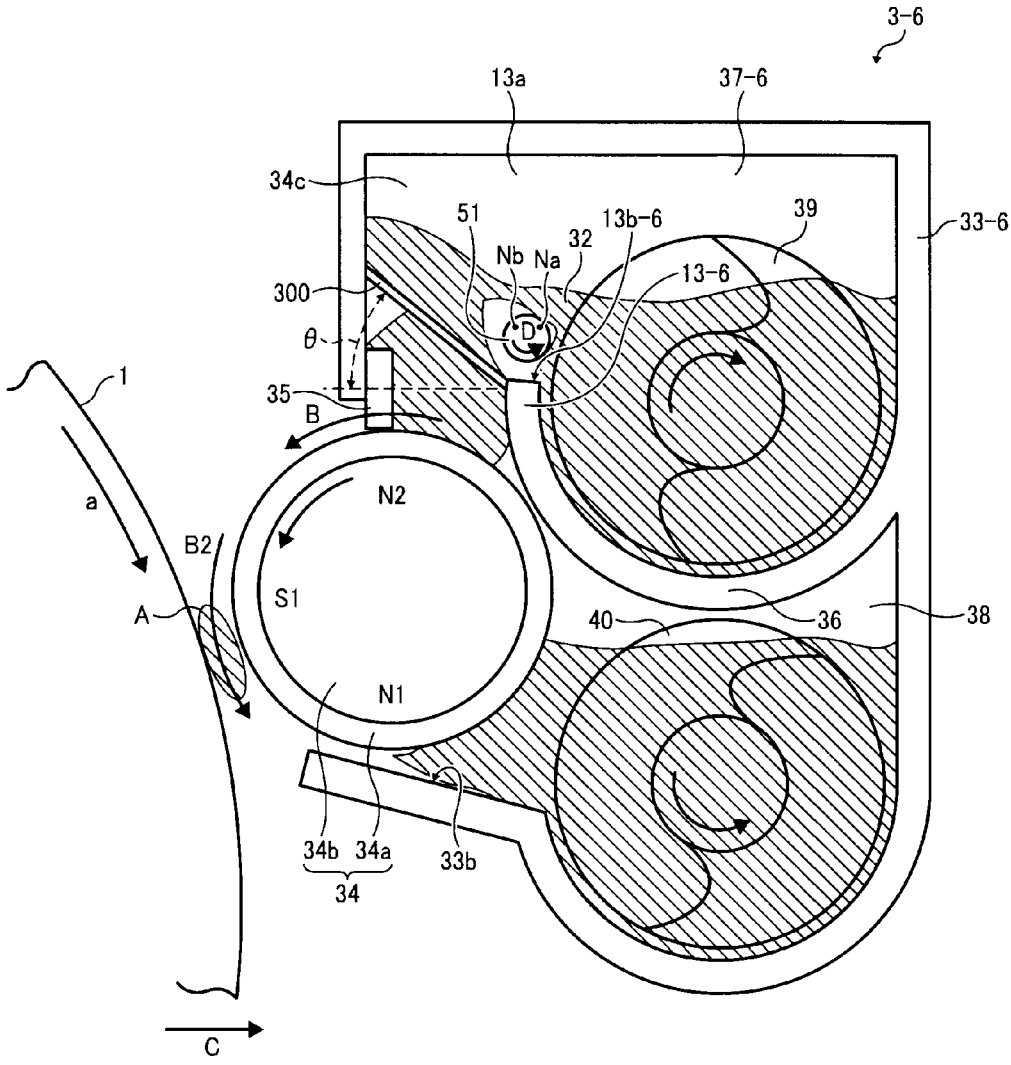
FIG. 18 is a diagram illustrating a development device according to a sixth illustrative embodiment, installable in the image forming apparatus shown in FIG. 1.

FIG. 18 shows a development device 3-6 installable in the printer 100, according to the sixth embodiment. As shown in FIG. 18, the development device 3-6 includes a sleeve member 51 that rotates and contains a magnetic field generating member such as magnet, instead of the paddle member 31 shown in FIGS. 2 and 17.

Similarly to the paddle member 31, the sleeve member 51 rotates in a counterclockwise direction indicated by arrow D shown in FIG. 17. FIGS. 19A and 19B are diagrams of a supply path 37-6 of the development device 3-6. FIG. 19A is a perspective view illustrating a wall portion 13*b*-6 in a partition 36-6 and the sleeve member 51 in the development device 3-6. FIG. 19B is a diagram illustrating a positional relation between the sleeve member, the height of the wall portion 13-6, and the level of the developer in the supply path 37-6 in the development device 3-6.

Initially, a circulation route of the developer 32 from the supply path 37-6 to the developing sleeve 34*a* in the development device 3-6 is described. As described above, in the development devices 3 to 3-5 according to the first through fifth embodiments, the developer 32 in the supply path 37-6 passes over the wall portion 13 as the supply screw 39-6 rotates, and then the developer 32 is conveyed to the developing sleeve 34*a* under its own weight.

However, in the present embodiment, the sleeve member 51 that contains the magnetic field generating member is provided above the wall portion 13-6, and accordingly the developer 32 in the supply path 37-6 is pumped up by the magnetic force generated in the magnetic field generating member in the sleeve member 51.

More specifically, a pump-up pole Na and a peeling-away pole Nb are provided as magnetic field generating members in the sleeve member 51. The developer 32 is pumped up above the sleeve 51 due to the magnetic force from the pump-up pole Na and is conveyed as the sleeve member 51 rotates. Subsequently, the developer is separated away from the surface of the sleeve member 51 in a separation portion facing the peeling-away pole Nb. At this time, because the magnetic force from the peeling-away pole Nb and a centrifugal force caused by rotating the sleeve member 51 are exerted on the developer 32, the developer 32 is blown close to an interior wall of a developer container 33-6 positioned above the developer regulator 35.

Then, the developer thus sent close to the interior wall of the developer container 33-6 falls under its own weight to the surface of the developing sleeve 34*a* after passing through the foreign object removal member 300.

In the development device 3-6 shown in FIG. 18, the magnetic field generated by the pump-up pole Na and a peeling-away pole Nb of the magnetic field generating member in the sleeve member 51 can cause the developer 32 to flow back to the supply path 37-6. More specifically, the developer 32 located in the lower range M1 shown in FIGS. 8A and 8B can flow back to the supply path 37-6 due to the magnetic force.

Namely, the sleeve member 51 has functions of not only a developer conveyance member that conveys the developer in the supply path 37-6 to the developing sleeve 34*a* but also of a developer softening member that softens the developer 32 so that agglomeration of the developer can be prevented while the development device is used for a long time.

Figure 19A:
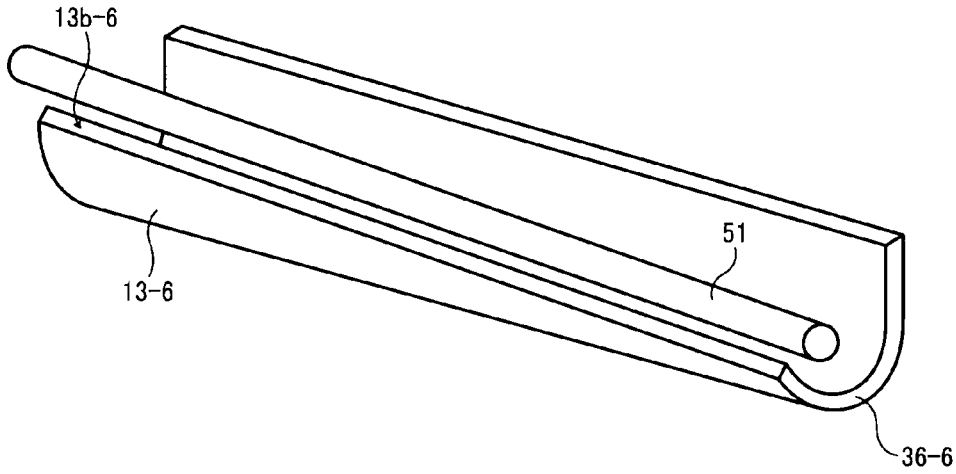
FIG. 19A is a perspective view illustrating a wall portion in a partition and a sleeve member in the development device shown in FIG. 18.
Figure 19B:
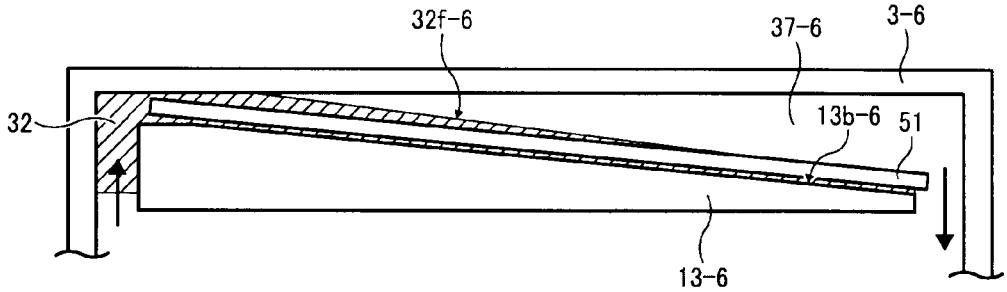
FIG. 19B is a diagram illustrating a position relation between the sleeve member, height of the wall portion shown in FIG. 19A, and level of the developer in a supply path in the development device shown in FIG. 18.

With reference to FIGS. 19A and 19B, it is preferable that the sleeve member 51 be disposed parallel to the slant of an upper end 13*b*-6 of the wall portion 13-6, that is, that a gap between the closest portion of the upper end 13*b*-6 of the wall portion 13-6 and the sleeve member 51 be kept constant. When the sleeve member 51 is set at this position, the developer 32 can be pumped up stably even where the level 32*f*-6 of the developer 32 becomes lower on the downstream side of the developer conveyance direction in the supply path 37.

As compared with the development device 3X according to the comparative example 2 shown in FIGS. 5 through 8B, while the developer 32X located lower than the upper end 13*b*X of the wall portion 13X cannot be conveyed to the developing sleeve 34*a*X side after passing over the wall portion 13X in the development device 3X.

By contrast, in the development device 3-6 according to the present embodiment, the developer 32 located lower than the upper end 13*b*-6 of the wall portion 13-6 in the supply path 37-6 can be conveyed due to the magnetic force generated by the magnetic field generating member in the sleeve member 51. Accordingly, in the development device 3-6, shortage of the developer that tends to occur in the downstream side in the supply path 37-6 in the unidirectional circulating development device 3-6 can be better prevented.

In addition, in the development device 3-6 shown in FIG. 18, because the developer 32 is conveyed to the sleeve member 51 due to the magnetic force, nonmagnetic foreign objects are less likely to be conveyed to the sleeve member 51. Furthermore, if the nonmagnetic foreign object sticks to the developer 32 in the supply path 37-6 and is conveyed to the sleeve member 51, the nonmagnetic foreign objects do not receive any binding force from the magnetic force and are separated from the surface of the sleeve member 51 by a centrifugal force of the rotating sleeve member 51. Then, the foreign object drops into the supply path 37-6.

Accordingly, because the foreign object is less likely to be conveyed to the surface of the sleeve member 51 and easily drops into the supply path 37-6 even if the foreign object is conveyed to the sleeve member 51, the foreign objects rarely reaches the foreign object removal member 300. Then, when the development device 3-6 is used for a long time, the possibility of clogging of the foreign object that remains on the upper surface of the foreign object removal member 300 can be reduced.

In addition, in general, on the upstream side in the developer conveyance direction in supply path 37-6, the amount of the developer 32 is greater and accordingly a greater amount of the developer may be easily conveyed from the supply path 37-6 to the developing sleeve 51. However, in the development device 3-6 according to the sixth embodiment, the sleeve member 51 rotates in a counterclockwise direction in FIG. 18, and the developer 32 that contacts the surface of the sleeve member 51 passes over the sleeve member 51 is conveyed toward the developing sleeve 34*a*. Therefore, if the great amount of developer 32 contacts the surface of the sleeve member 51, the excessive developer 32 that cannot be borne by the magnetic force from the magnetic force generating member in the sleeve member 51 drops into the supply path 37-6, and as a result, the developer does not become insufficient on the downstream side in the developer convince direction in supply path 37-6.

Moreover, if the rotation direction of the sleeve member 51 is set to a clockwise direction in FIG. 18, the developer in the supply path 37-6 passes through a narrow gap between the sleeve member 51 and upper end 13*b*-6 of the wall portion 13, accordingly, the developer receives stress and the developer becomes degraded.

However, as described above, in the development device 3-6 including the rotary sleeve member 51 containing the magnetic force generating member, the direction in which the sleeve member 51 rotates is preferably set so that the surface of the sleeve member 51 facing the supply path 37 moves toward an upper portion of the sleeve member 51, passes a portion facing to the developer retaining space 34*c*-6, and then passes a portion facing the upper end 13*b*-6 of the wall portion 13-6 (in FIG. 18, the counterclockwise direction). Therefore, the depletion of the developer 32-6 in the downstream side in the developer conveyance direction in supply path 37-6 and the deterioration of the developer 32 can be prevented.

Accordingly, the rotation direction is preferable in the counterclockwise direction in FIG. 18 than the clockwise direction in the configuration shown in FIG. 18.

Furthermore, the level 32*f*-6 of the developer 32 generally becomes uneven following the screw shape of the supply screw 39-6. When the developer 23 is conveyed from the supply path 37-6 to the sleeve member 51, the amount of the developer 32 supplied to the sleeve member 51 may become uneven in accordance with the fluctuation of the level 32*f*-6 of the developer 32 in the supply path 37-6 particularly on the downstream side in the developer conveyance direction in the supply path 37-6 where the amount of developer is significantly decreased. When the developer 32 whose amount is uneven passes through the doctor gap between the developer regulator 35 and the developing sleeve 34*a*, the image unevenness may be caused by screw pitch that is called "pitch unevenness".

However, in the present embodiment, the developer is not affected by the magnetic force from the time after the developer is peeled away from the sleeve member 51 to the time before the developer arrives at the surface of the developing sleeve 34*a*. Therefore, even if the developer supplied to the surface of the sleeve member 51 fluctuates, the fluctuation can be alleviated while the developer is conveyed from the sleeve member 51 to the developing sleeve 34*a*. Then, image failure caused by screw pitch is less likely to occur.

It is to be noted that, although the magnetic field generating member contains two magnetic poles whose polarities are same in the development device 3-6 shown in FIG. 18, the magnetic field generating member in the sleeve member can adopt single magnetic pole.

When the magnetic field generating member is formed of single magnetic pole, the single pole is disposed in a portion disposed at the pump-up pole Na shown in FIG. 18, and the magnetic field generating member including the single pole is set so that the developer is peeled away at the portion where the peeling-away pole Nb is positioned in FIG. 18 due to the centrifugal force by rotation of the sleeve member 51. When the centrifugal force by rotation of the sleeve member 51 becomes larger than a binding force from the magnetic force from the magnetic pole in the sleeve member 51, the developer 32 is peeled away from the surface of the sleeve member 51. Subsequently, the developer 32 after peeled away the surface of the sleeve member 51 is conveyed to a portion above the developer regulator 35 and close to the interior wall of the developer container 33-6.

As described above, when the development device 3-6 includes single magnetic pole in the sleeve member 51, in order to peel the developer 32 away from the surface of the sleeve member 51 smoothly, the magnet pole is disposed so that magnetic flux density in a direction normal to the surface of the sleeve member 51 decreases to equal to or lower than 5 mT (milli-tesla).

Seventh Embodiment

Next, a seventh embodiment is described below with reference to FIGS. 20 to 30.

Figure 20:
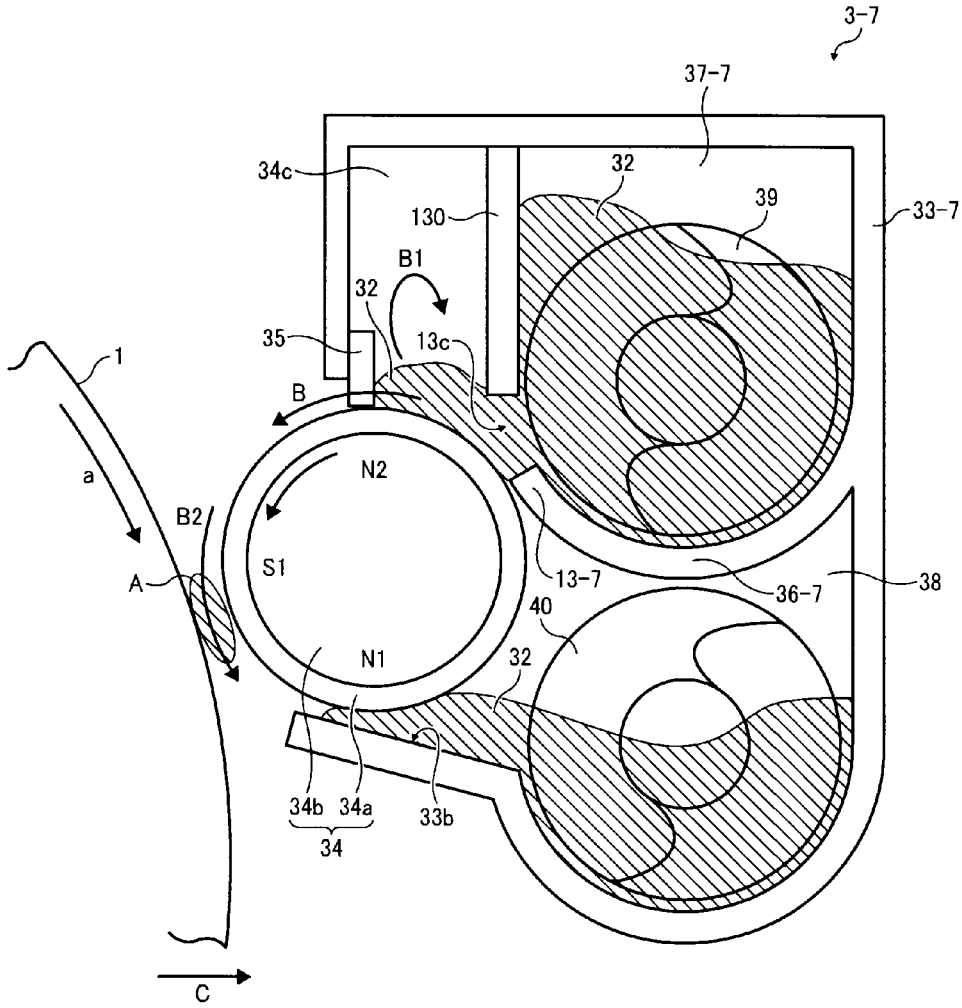
FIG. 20 is a diagram illustrating a development device according to a seventh illustrative embodiment, installable in the image forming apparatus shown in FIG. 1.
Figure 21A:
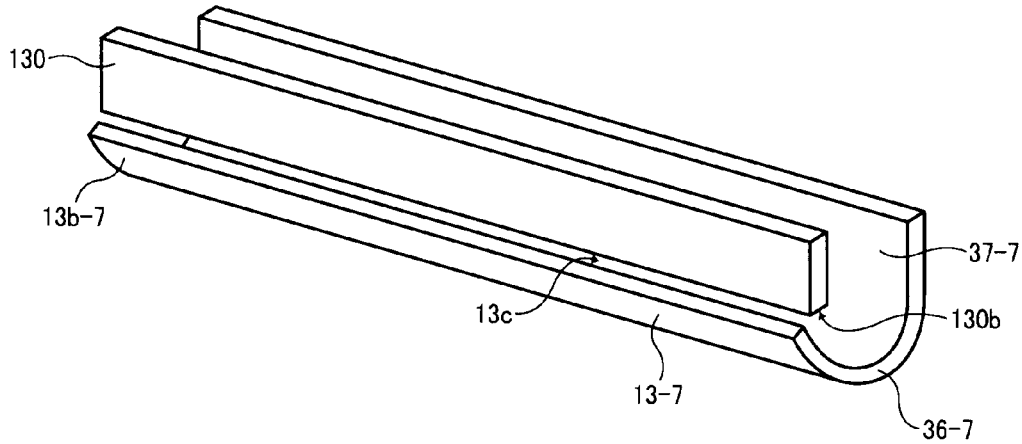
FIG. 21A is a perspective view illustrating a partition forming a supply path and a shield wall included in the development device shown in FIG. 20.
Figure 21B:
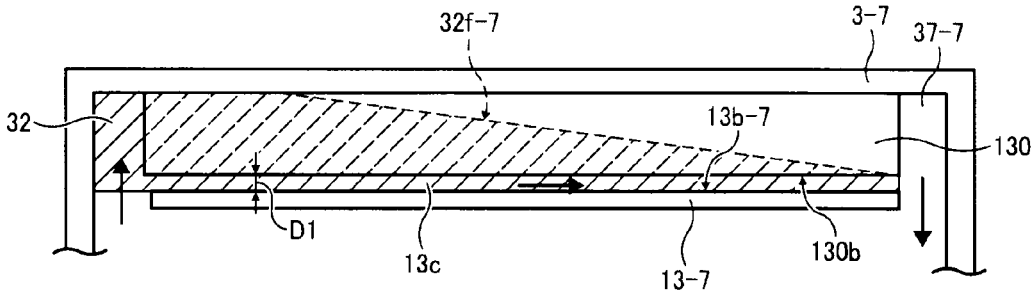
FIG. 21B is a diagram illustrating a relation between height of a communication hole formed in the development device shown in FIG. 20 and level of the developer in the supply path shown in FIG. 21A.

FIG. 20 is a diagram illustrating a development device 3-7 installable in the printer 100, according to the seventh embodiment. As shown in FIG. 20, the development device 3-7 includes a shield wall 130 that shields a portion between the supply path 37-7 and the developer retaining space 34*c*-7 in a portion above the wall portion 13, and an upper end of a communication hole 13*c* of a wall portion 13-7 is formed by the shield wall 130. FIGS. 21A and 21B are illustrative diagrams of the supply path 36-7 in the development device 3-7. FIG. 21A is a perspective view illustrating a partition 36-7 and the shield wall 130. FIG. 21B is a diagram illustrating a relation between the height of the wall portion 13-7 in the development device 3-7 and level 32*f* of the developer 32 in the supply path 37-7.

As shown in FIG. 21B, similarly to the comparative example 2 shown in FIGS. 6A and 6B, the dispersion of the amount of the developer 32 is uneven in the supply path 37-7, level 32*f*-7 of the developer 32 become progressively higher as the amount of the developer increases on the upstream side in the developer conveyance direction in the supply path 37-7, and the level 32*f*-7 of the developer 32 becomes progressively lower as the developer flows downstream.

However, in this embodiment, the communication hole 13*c* is formed between the upper end 13*b*-7 of the wall portion 13-7 and a lower end 130*b* of the shield wall 130. Thus, only the developer that has passed through the communication hole 13*c* can be supplied to the developer retaining space 34*c*-7.

Therefore, even if the dispersion of the amount of the developer 32 is uneven in the supply path 37-7 and the level 32*f*-7 of the developer 32 fluctuates, the development device 3-7 can supply the developer 32 stably to the developing sleeve 34*a* without being affected by the height of the level 32*f*-7 of the developer in the supply path 37-7.

Figure 22A:
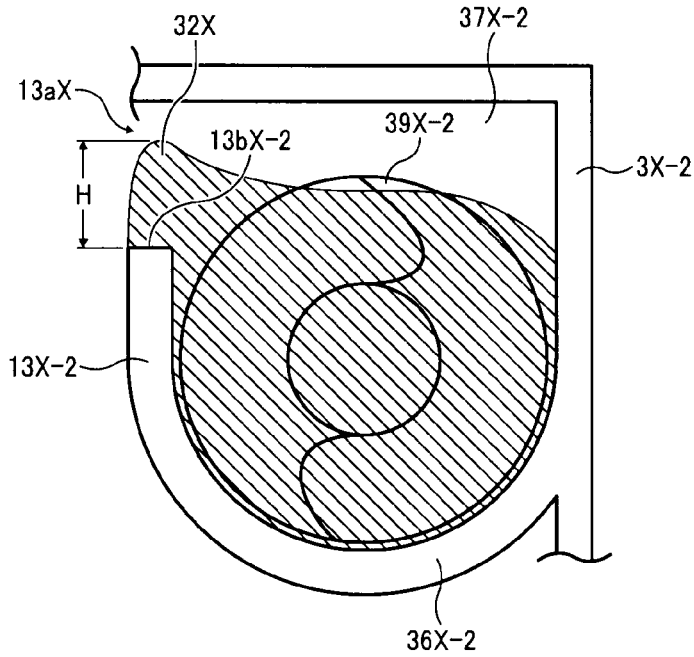
FIG. 22A is an enlarged view illustrating vicinity of the supply path shown in FIGS. 7A and 7B and illustrating the developer in an upstream portion in the supply path in the developer conveyance direction when the amount of the developer is greater in the development device according to the second comparative example.
Figure 22B:
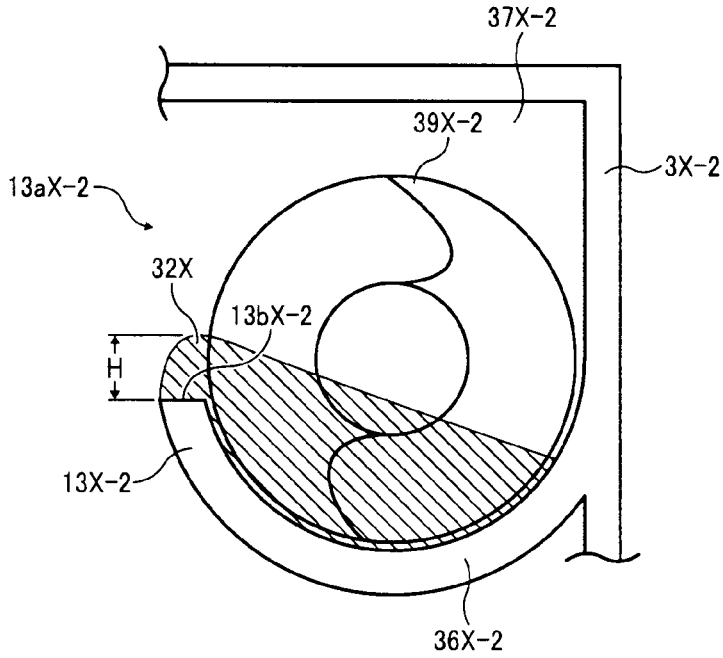
FIG. 22B is an enlarged view illustrating vicinity of the supply path shown in FIGS. 7A and 7B and illustrating the developer in a downstream portion in the supply path when the amount of the developer is fewer in the development device.
Figure 23A:
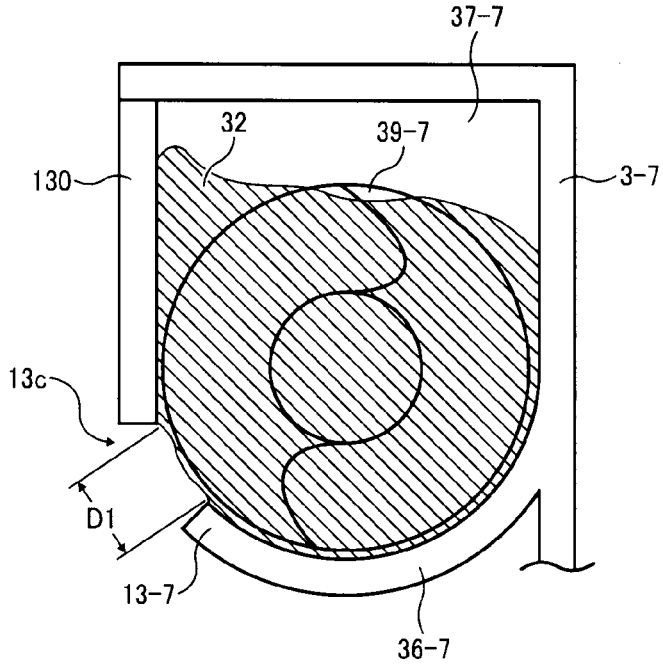
FIG. 23A is an enlarged view illustrating vicinity of the supply path shown in FIGS. 21A and 21B and illustrating the developer in an upstream portion in the supply path in the developer conveyance direction when the amount of the developer is greater in the development device.
Figure 23B:
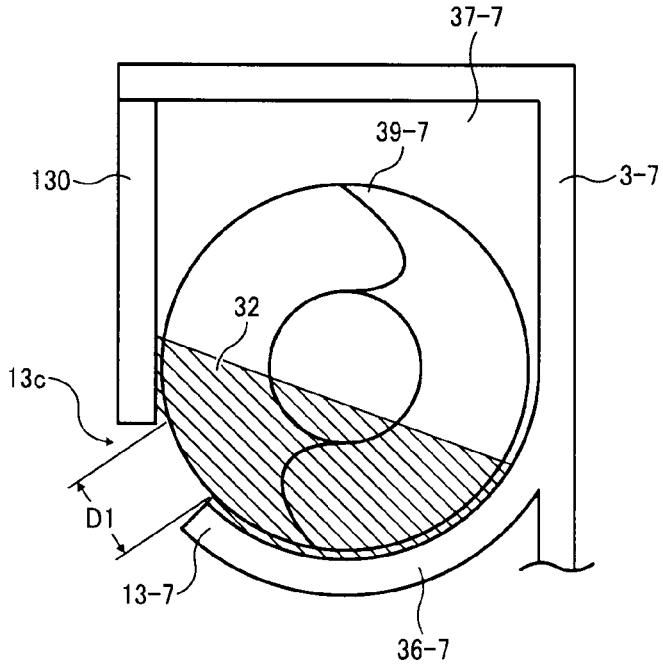
FIG. 23B is an enlarged view illustrating vicinity of the supply path shown in FIGS. 21A and 21B and illustrating the developer in a downstream portion in the supply path when the amount of the developer is fewer in the development device.

FIGS. 22A and 22B are expanded diagrams illustrating vicinity of the supply path 37X-2 in the comparative example 2-2 of the development device 3X-2 shown in FIGS. 7A and 7B. FIG. 22A illustrates the developer 3X in the upstream portion in the supply path 37X-2 in the developer conveyance direction when the amount of the developer 32X is greater in the development device 3X-2, and FIG. 22B illustrates the developer 32X in the downstream portion in the supply path 37X-2 when the amount of the developer 32X in the development device 3X-2 is smaller.

As shown in FIGS. 22A and 22B, in the configuration in which the wall portion 13X-2 projecting from the lower side adjusts the supplying amount of the developer, the difference H between the upper end 13*b*X-2 and the level 32*f*-X of the developer 32X is changed in accordance with the height of the wall portion 13X-2 and the level 32*f*X-2 of the developer 32X. By contrast, in the development device 3-7 of the present embodiment, the supplying amount of the developer 32 is controlled by the size of a width D of the communication hole 13*c* between the wall portion 13 and the shield wall 130 projecting from the upper side, regardless of fluctuation of the amount of the developer in the supply path 37-7.

Accordingly, the amount of the developer supplied from the supply path 37-7 to the developing sleeve 34*a* is not affected by the unevenness and fluctuation of the amount of the developer in the supply path 37-7 in the developer conveyance direction, and stable supplying amount can be secured.

Next, another advantage of the present embodiment is described below.

Figure 24A:
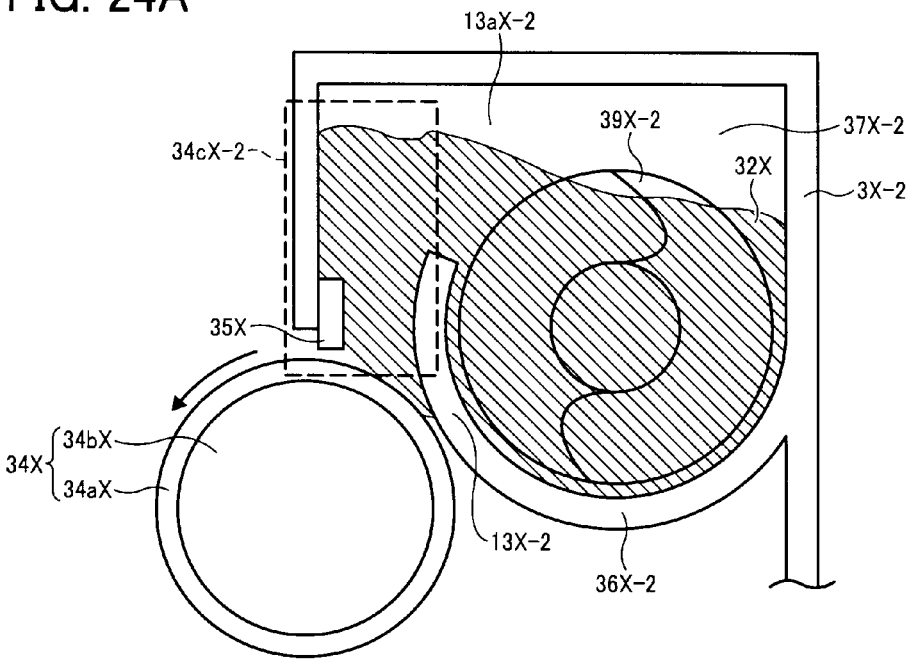
FIG. 24A is an enlarged view illustrating the supply path shown in FIGS. 7A and 7B, a developer retaining space, and a developing roller shown in FIG. 5 and illustrating the developer in the upstream portion in the supply path in the developer conveyance direction when the amount of the developer is grater in the development device according to the second comparative example.
Figure 24B:
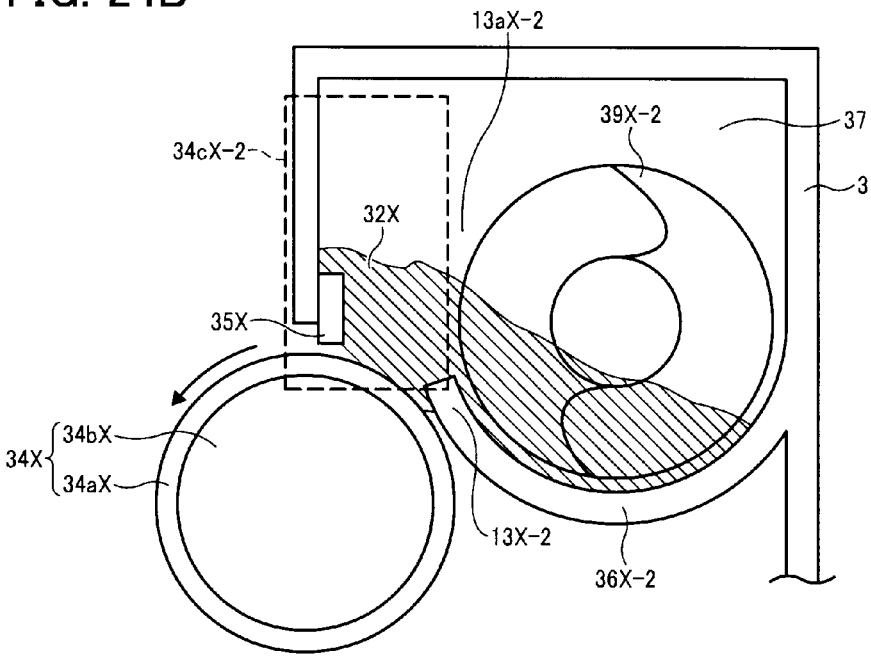
FIG. 24B is an enlarged view illustrating the supply path, the developer retaining space, and the developing roller, and illustrating the developer in downstream portion in the supply path shown in FIG. 24A when the amount of the developer is fewer in the development device.

FIGS. 24A and 24B are enlarged views illustrating the supply path 37X-2, the developer retaining space 34*c*X, and the developing roller 34X according to the comparative example 2-2 shown in FIGS. 7A and 7B. FIG. 24A illustrates the developer 32X in the upstream portion in the supply path 37X-2 in the developer conveyance direction when the amount of the developer 32X is grater in the development device 3X-2, and FIG. 24B illustrates the developer 32X in downstream portion in the supply path 37X-2 when the amount of the developer is smaller.

Figure 25A:
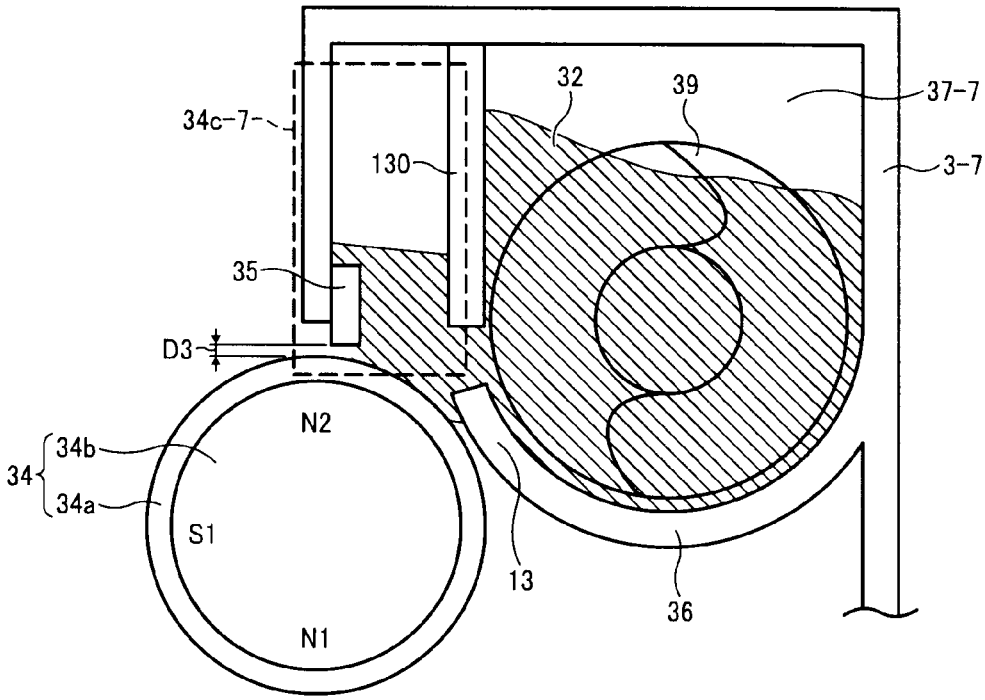
FIG. 25A is an enlarged view illustrating the supply path shown in FIGS. 23A and 23B, a developer retaining space, and a developing roller shown in FIG. 20 and illustrating the developer in the upstream portion in the supply path in the developer conveyance direction when the amount of the developer is grater in the development device shown in FIG. 20.
Figure 25B:
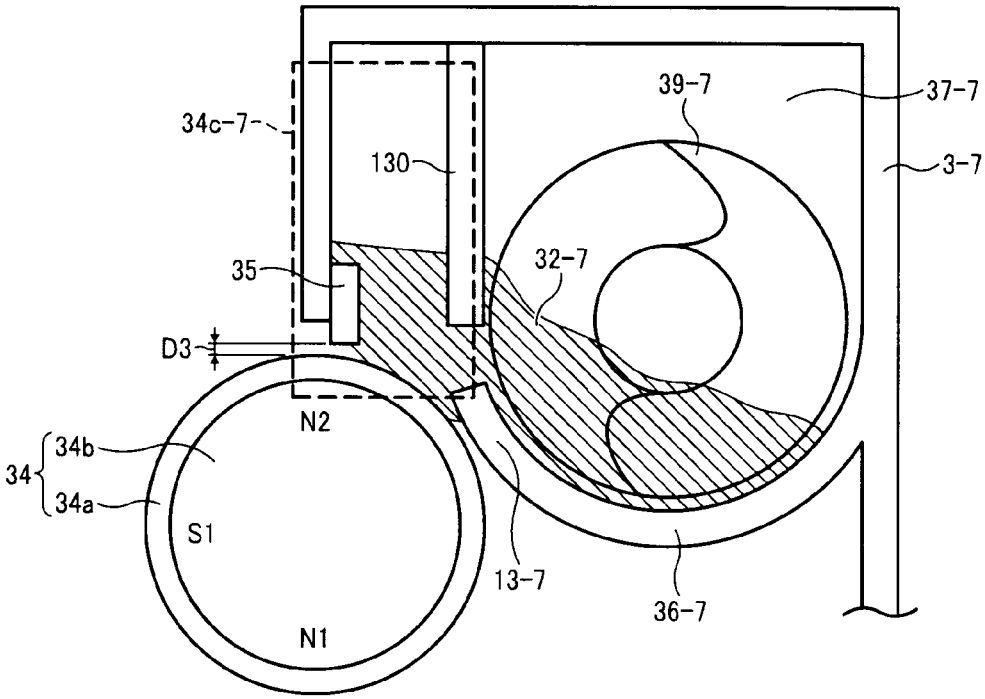
FIG. 25B is an enlarged view illustrating the supply path, the developer retaining space, and the developing roller shown in FIG. 25A, and illustrating the developer in downstream portion in the supply path when the amount of the developer is fewer in the development device.

FIGS. 25A and 25B are enlarged views illustrating the supply path 37-7, a developer retaining space 34*c*-7, and a developing roller 34-7 according to the present embodiment shown in FIGS. 20 through 21B. FIG. 25A illustrates the developer 32 in the upstream portion in the supply path 37-7 in the developer conveyance direction when the amount of the developer 32 is greater, and FIG. 25B illustrates the developer 32 in the downstream portion in the supply path 37-7 when the amount developer 32 is smaller.

As described above, generally, the developer in a supply path tends to decrease gradually as the developer flows downstream in the developer conveyance direction in the supply path. As a result, when the developer is excessively supplied to the developing sleeve in the upstream portion in the developer conveyance direction, the developer cannot be supplied to the developing sleeve in the downstream portion in the developer conveyance direction. Accordingly, shortage of the developer supplied to the developing sleeve may occur in the downstream portion in the supply path.

As for one example, in the comparative example 2-2 with reference to FIGS. 24A and 24B, the amount of the developer 32X retained in the developer retaining space 34*c*X-2 positioned just upstream from the developer regulator 35X fluctuates in accordance with the height of the wall portion 13X and the amount of the developer 32X in the supply path 37X-2. In this comparative example 2-2, conveyance force to convey the developer 32X to the downstream portion in the developer conveyance direction in the supply path 37 is not exerted on the developer 32X once supplied to the developer retaining space 34*c*X-2. Therefore, when the excessive amount of the developer 32X is supplied to the developer retaining space 34*c*X-2, the amount of the developer 32X in the downstream portion in the developer conveyance direction in the supply path 37X is decreased and the developer supplied from the supply path to the developing sleeve 34*a*X becomes insufficient in the downstream portion in the developer conveyance direction in the supply path 37X.

In addition, as shown in FIGS. 8A and 8B, when the excessive developer 32X is supplied to the developer retaining space 34*c*X, the load to the developer by the developer's own weight increases, and the deterioration of the developer becomes significant, which is not desirable. Moreover, when the amount of developer 32X is greater in the developer retaining space 34*c*-X, the load exerted on the developer regulator 35X and the developing sleeve 34*a*X is enhanced, and therefore, the deformation of the developer regulator 35X and the developing sleeve 34X may be caused, which is a problem.

By contrast, in the development device 3-7 according to present embodiment, with reference to FIGS. 25A and 25B, regardless of the amount of the developer in the supply path 37-7, a certain amount of the developer 32 can be conveyed to the developer retaining space 34*c*-7, and therefore, shortage of the developer supplied from the supply path 37-7 can be prevented.

It is to be noted that a cause of the above-described inconvenience due to the excessive amount of the developer 32X in the developer retaining space 34*c*X is that the developer can be supplied excessively on the upstream side in the supply path 37.

Figure 26A:
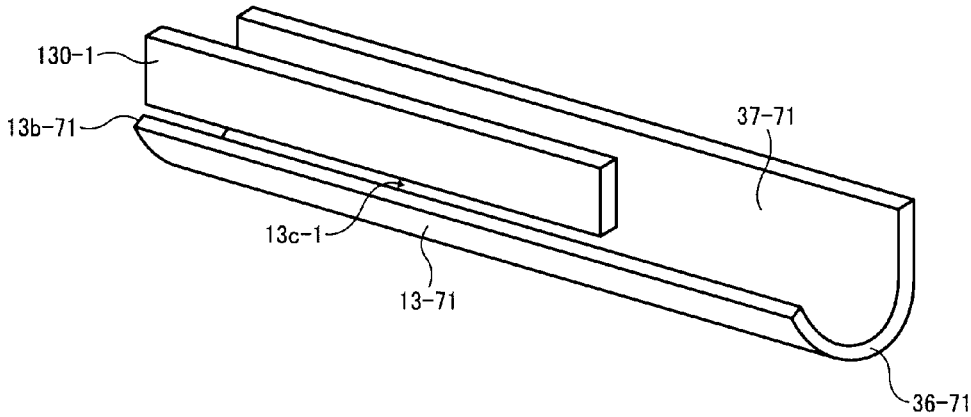
FIG. 26A is a perspective view illustrating a partition forming a supply path and a variation of the shield wall that shields not entirely to the downstream end above the supply path in the development device shown in FIG. 20.
Figure 26B:
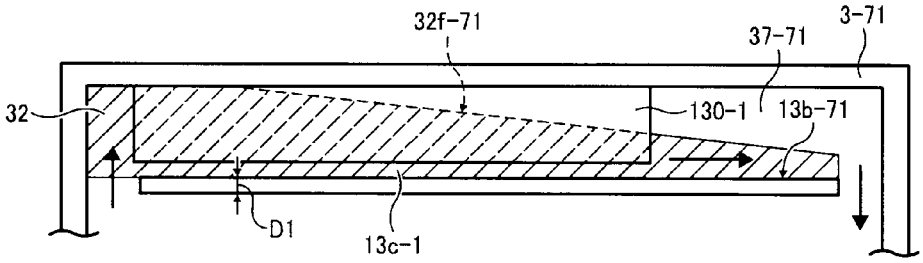
FIG. 26B a diagram illustrating a relation between a communication hole formed by the shield wall shown in FIG. 26A and level of the developer in the supply path.

FIG. 26A is a perspective view illustrating a partition forming a supply path and a variation of a shield wall 130-1 that partially shields the downstream end above a supply path 37-71 in the development device 37-7 shown in FIG. 20. FIG. 26B a diagram illustrating a relation between a communication hole 13*c*-1 formed by the shield wall 130-1 shown in FIG. 26A and level of the developer 32 in the supply path 32-7.

Therefore, with reference to FIGS. 26A and 26B, a development device 3-71 includes, instead of the shield wall 130 shown in FIGS. 21A and 21B, a shield wall 130-1 that extends from the extreme upstream portion partly toward the downstream end, up to a certain position upstream from the downstream end, leaving the downstream end portion unshielded, which can also prevent the problem caused by the excessive developer. This configuration is also applicable as a variation of the seventh embodiment.

Figure 27:
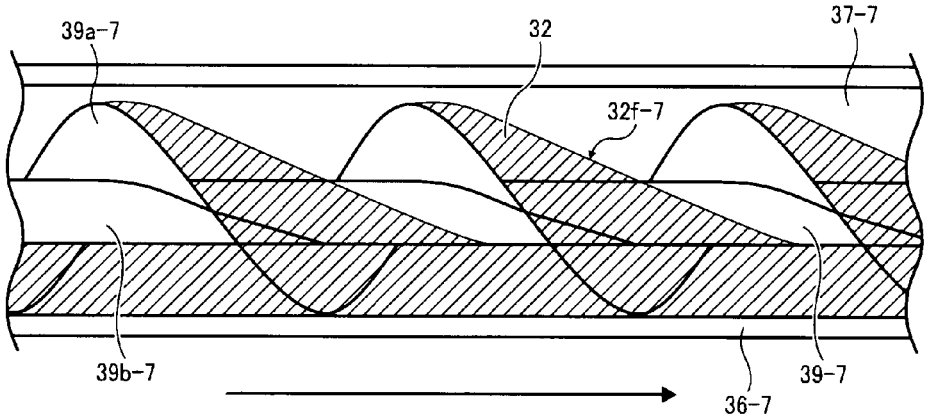
FIG. 27 is a diagram illustrating relation between the dispersion of the developer conveyed by a supply screw in the supply path shown in FIGS. 21A and 21B.

FIG. 27 is a diagram illustrating a relation between the dispersion of the developer conveyed by the supply screw 39-7 in the supply path 37-7. As shown in FIG. 27, the supply screw 39-7 that has a rotary shaft 39*a*-7 and a fin 39*b*-7 shaped bladed spiral surrounding the rotary shaft 39*a*-7 conveys the developer 32 in the direction indicated by arrow shown in FIG. 27 along the axis of the rotary shaft 39*b*-7.

In the supply path 37-7 shown in FIG. 27, the dispersion of the developer 32 conveyed by the supply screw 39-7 is uneven in a portion between adjacent two upward projecting portions of the fin 39*b*-7 of the supply screw 39-7 (hereinafter "between a screw pitch"). The amount of the developer is greater in an immediate downstream portion from the projecting portion of the screw blade 39*a*-7 and the amount of the developer 32 becomes smaller as the developer flows downstream in a space partitioned by the screw blade 39*b*. Namely, the level 23*f* of the developer 32 may fluctuate in a portion between screw pitch.

Therefore, as in the development device 3X-2 according to the comparative example 2-2, in the configuration in which the developer 32 after it passes over the wall portion 13X is supplied to the developer retaining space 34*c*X, the amount of the developer 32 supplied to the developing sleeve 34*a*X becomes uneven because affected by the fluctuation in the level 32*f*X of the developer 32X between the screw pitch. As a result, because the developer 32X whose amount is uneven passes through the doctor gap between the developing sleeve 34*a*X and the developer regulator 35X and is supplied to the developing range AX, fluctuation of the developer 32X from the screw pitch causes image failure, which is a problem.

By contrast, in the present embodiment, the developer 32 after passing through the communication hole 13*c* formed beneath the level 32*f*-7 of the developer 32 is supplied to the developer retaining space 34*c*-7 and further supplied to the developing sleeve 34*a*-7. In this configuration, because the developer 32 is supplied from a portion facing the communication hole 13*c* where the dispersion of the amount of the developer in the supply path is uniform to the developer retaining space 34*c*-7, image unevenness resulting from the screw pitch is less likely to be caused.

In the development device 3-7 according to the seventh embodiment, the uniform amount of developer 32 can be stably supplied in the axis direction of the developing sleeve 34*a*, without harmful effect such as the unevenness and fluctuation in the amount of the developer 32 in the developer conveyance direction in the supply path 37-7. When the developer 32 is supplied stably and uniformly, the supply of excessive developer on the upstream side in the supply path 37-7 can be prevented, and therefore, the deterioration of the developer and the deformation of the developing sleeve 34*a* caused by supplying excessive developer to the developing sleeve 34*a* can be prevented.

In addition, the insufficient supply of the developer on the downstream side in the developer conveyance direction in the supply path 37-7 can be prevented.

Accordingly, in the developing range A, while the toner concentration can be maintained in the axis direction of the developing sleeve 34*a*, the uniformed amount of the developer and the uniformed developing gap can be secured, and as a result, the image quality can be improved.

In addition, as shown in FIG. 21B, because the shield wall 130 is provided so that the upper end of the communication hole 13*c* is positioned lower than the lowest portion of the level 32*f*-7 of the developer 32, developer can be supplied uniformly to the surface of the developing sleeve 34*a* entirely in the axis direction thereof.

It is to be noted that, although the shield wall 130 completely shields the portion over the communication hole 13*c* in the present embodiment, the shield wall 130 is not limited to this configuration. Alternatively, as a variation of the shield wall 130 shown in FIGS. 26A and 26B, the shield wall 130 can be configured to prevent or restrict the supply of the developer 32 from the portion above the communication hole 13*c* having a certain width to the developer retaining space 34*c*-7.

Moreover, in FIG. 20, the communication hole 13*c* is provided lower than the position where the developer 32 is borne to the surface of the developing sleeve 34*a* due to the magnetic force from the magnetic pole N2. It is desirable that the communication hole 13*c* be provided above the position shown in FIG. 20 so that the developer 32 after passing through the communication hole 13*c* falls to a portion where the developer 32 is borne to the surface of developing sleeve 34*a* attracted by the magnetic force from the magnetic pole N2.

It is to be noted that fluidity of the developer 32 may decline with time. The developer 32 whose fluidity becomes lower is more likely to form agglomeration, and when the coagulated developer 32 is caught in the communication hole 13*c*, the supply from the supply path 37-7 to the developer retaining space 34*c*-7 is blocked in the clogged portion. Therefore, the amount of the developer supplied to the developing sleeve may become insufficient. In addition, in the development device 3-7 according to the present embodiment, because the developer 32 in the supply path 37-7 is supplied to the developer retaining space 34*c*-7 under its own weight, the force to cause the developer to move through the communication hole 13*c* is not exerted.

Accordingly, once the developer caught in the communication hole 13*c*, the force to remove the clogged developer is not exerted.

Figure 28:
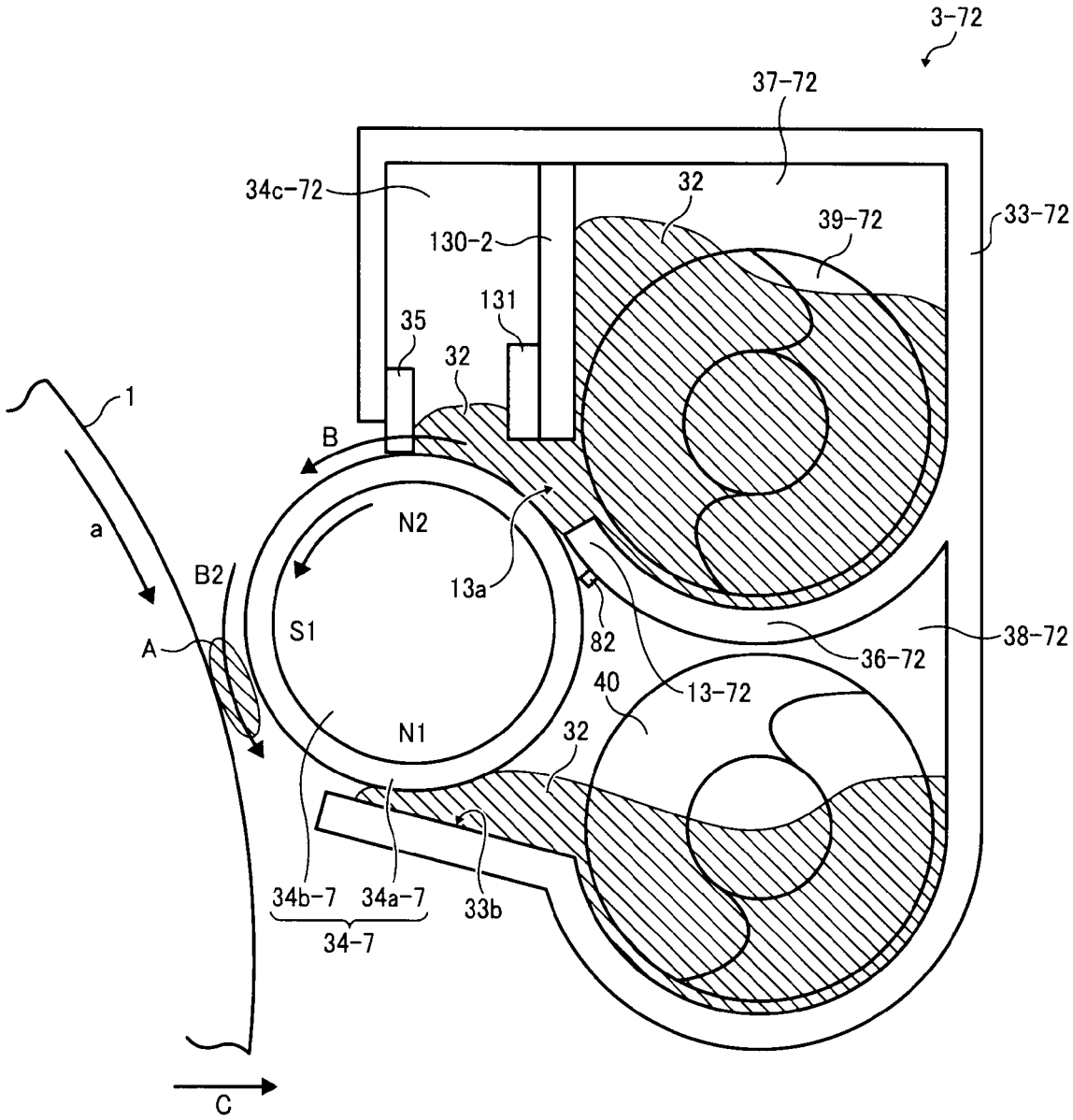
FIG. 28 is a diagram illustrating another variation of the seventh illustrative embodiment of a development device shown in FIG. 20 further including a vibration member and an infilling member.

In order to avoid this failure, as another variation of the development device 3-72, with reference to FIG. 28, a vibration member 131 such as ultrasonic oscillator 131 that transmits vibration to a shield wall 130-2 can be provided on the shield wall 130. The vibration member 131 is driven while the development device 3-72 drives and keeps transmitting the vibration to the shield wall 130-2, and as a result, the developer 32 can be prevented from coagulating and fluidity can be maintained.

It is to be noted that, alternatively, it is not necessary to drive the vibration member 131 constantly while the development device 3-72 is driven, and the vibration member 131 may be driven intermittently or driven only a predetermined or given period such as a period after developing performance is finished.

If a gap between the wall portion 13-7 and the developing sleeve 34*a* is wide, the developer 32 may fall into the recovery path 38-7 without bearing to the developing sleeve 34*a*. In order not to fall the developer 32 directly into the recovery path 38-7, as another variation of the development device 3-73 shown in FIG. 28, an infilling member 82 can be provided upstream in a direction in which the developer 32 moves on the surface of the developing sleeve 34*a*-7 from a position where the communication hole 13*c* and the developing sleeve 34*a* faces each other. The infilling member 82 that reduces the gap between the wall portion 13-7 of the partition 36-7 and the surface of the developing sleeve 34*a* is provided on the partition 36-7, and therefore, the developer 32 can be prevented from falling directly to the recovery path 38-7. Accordingly, the developer 32 can be more reliably supplied to the developing sleeve 34*a*.

At this time, when the infilling member 82 contacts the developing sleeve 34*a*, the developing sleeve 34*a* may abrade. In order to avoid this abrasion, it is preferable that the infilling member 82 be formed of a flexible, soft member, such as urethane foam.

Further, it is desirable that the supply screw 39-7 rotate in direction so that a screw fin 39*a* moves from lower to upper on the developer retaining space 34*c*-7 side viewed from the rotary shaft 39*b*.

Herein, with reference to FIGS. 29A and 29B, a relation between the rotation direction of the supply screw 39-7 and gradient of the level 32*f*-7 of the developer 32 in the supply path 37-7 is described below.

Figure 29A:
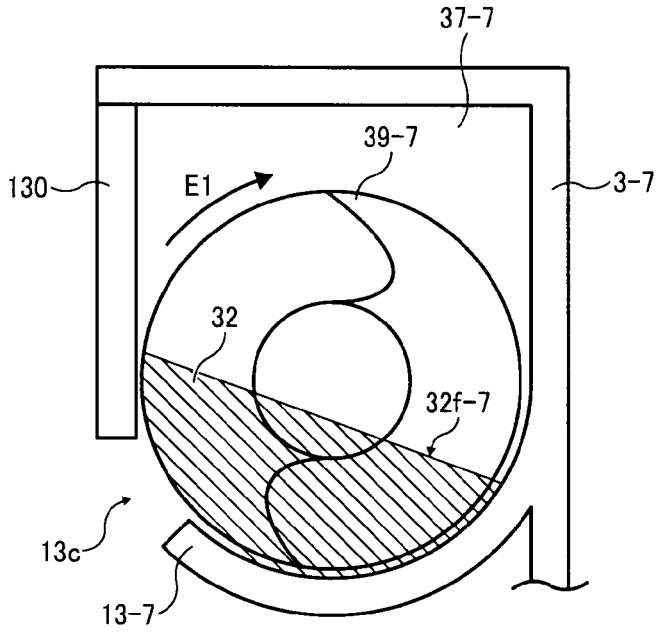
FIG. 29A a diagram illustrating relation between rotation direction of a supply screw and gradient of the level of the developer when the supply screw 7 rotates in a direction in the development device shown in FIG. 20

FIG. 29A illustrates the developer 32 in the supply path 37-7 when the supply screw 39-7 rotates in a direction indicated by arrow E1 shown in FIG. 29A, so that the supply fin 39*c* moves from lower to upper on the left side relative to the rotary shaft 39*b*-7 shown in FIG. 29A.

Figure 29B:
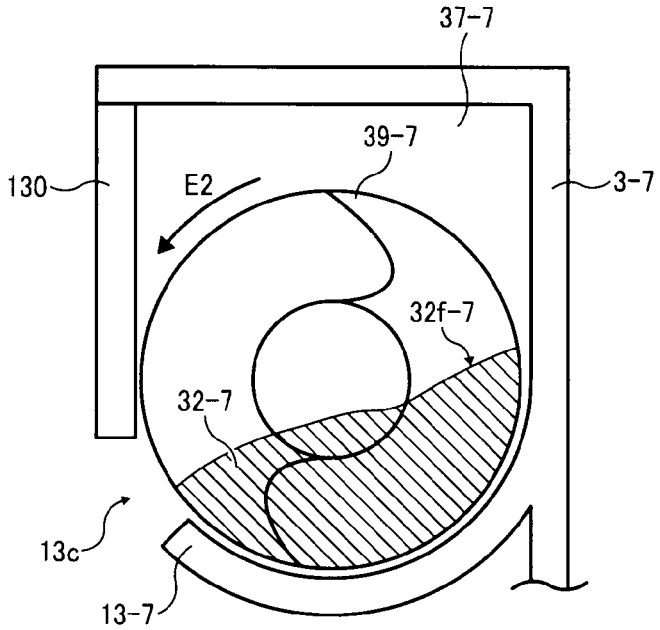
FIG. 29B a diagram illustrating relation between rotation direction of the supply screw shown in FIG. 20 and gradient of the level of the developer when the supply screw rotates in an opposite direction of the direction shown in FIG. 29A.

FIG. 29B illustrates the developer 32 in the supply path 37-7 when the supply screw 39-7 rotates in a direction indicated by arrow E1 (opposite direction of the direction indicated by the arrow E1) shown in FIG. 29A.

As shown in FIGS. 29A and 29B, even if the amount of the developer is almost similar in the supply path 37-7, the level 32*f*-7 of the developer 32 becomes higher by rotating the supply screw 39 in the E1 direction, and the developer 32 is more likely to cover the communication hole 13*c*. Because the developer 32 always covers the communication hole 13*c*, the developer 32 is reliably supplied to the developer retaining space 34*c*.

The slit-like communication hole 13*c* provided in the development device 3-7 is not limited to the configuration in which only a single communication hole 13*c* extends entirely from the extreme upstream to the extreme downstream in the supply path 39. Alternatively, multiple communication holes 13*c*-3 can be provided as shown in FIG. 30A and 30B.

Figure 30A:
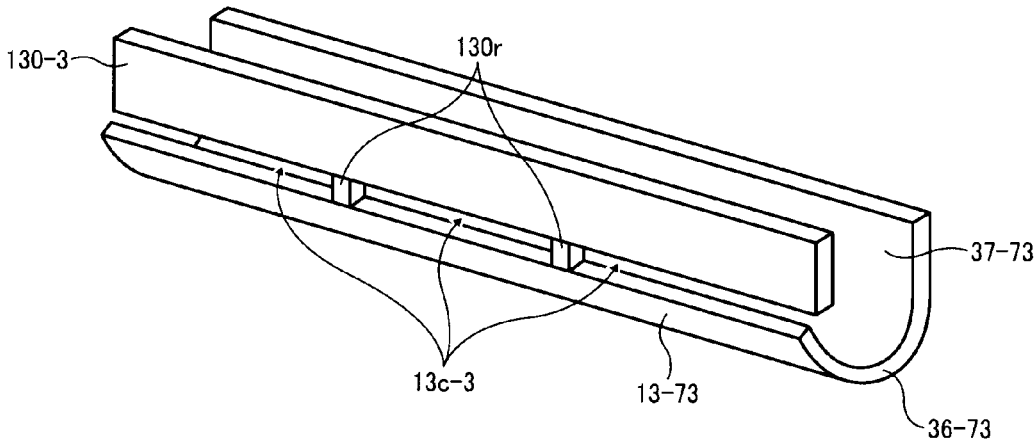
FIG. 30A is a perspective view illustrating a partition forming a supply path and a shield wall included in another variation of the development device shown in FIG. 20, in which multiple communication holes are formed between the supply path and the shield wall.

FIG. 30A is a perspective view illustrating a partition forming a supply path 37-73 and a shield wall 130-3 included, in which multiple communication holes are formed between the supply path 37-73 and the shield wall 130-3. FIG. 30B is a diagram illustrating a relation between the multiple communication holes 13*cr* in the development device shown in FIG. 30A and level of the developer in the supply path.

Figure 30B:
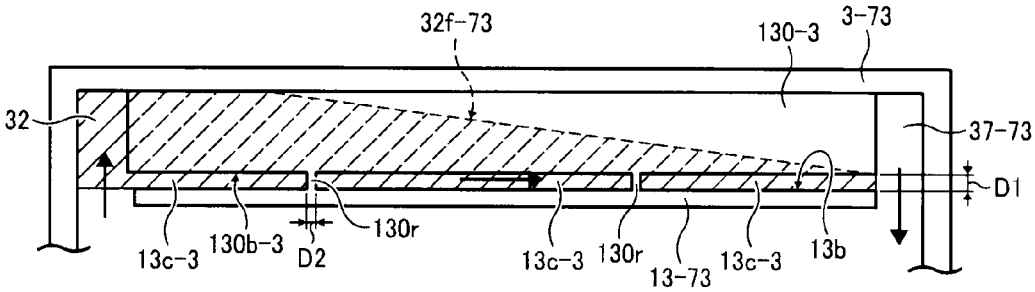
FIG. 30B is a diagram illustrating a relation between the multiple communication holes in the development device shown in FIG. 30A and level of the developer in the supply path.

In the configuration shown in FIGS. 30A and 30B, the communication hole 13*c*-3 is separated by a rib 130*r* connecting between the shield wall 130 and the wall portion 13-73. When the communication hole 13*c* is formed with a single hole as shown in FIGS. 21A and 21B, the lower end 130*b*-7 of the shield wall 130 and the upper end 13*f*-7of the wall portion 13-7 are free ends, and the free ends of the shield wall 130 and the wall portion 13-7 is deform, and the width D1 of the communication hole 13*c* may fluctuate.

By contrast, as shown in FIGS. 30A and 30B, the lower end of the shield wall 130-3 is connected to the upper end 13*b*-72 of the wall by the rib 130*r*, and the shield wall 130-3 and the wall portion 13-73 is less likely to deform and the width D1 of the communication hole 13*c*-3 can be kept easily. Because the developer 32 in the supply path 37-73 has the velocity component in a direction indicated by arrow shown in FIG. 30B, when the width D of the communication hole 13*c*-3 is sufficiently narrow (e.g., ranging 1 mm to 8 mm), the deformation of the free ends of the upper end 13*f*-7 of the wall portion 13-7 and the lower end of the shield wall 130 can be prevented with the width D1 of the communication hole 13*c* kept constant. At this time, the developer 32 whose amount is uniform in the axis direction of the developing sleeve 34*a* can be supplied to the developer retaining space 34*c*.

It is to be noted that, if the width D1 of the communication hole 13*c* is excessively narrow as compared with a doctor gap D3 between the developer regulator 35 and the developing sleeve 34*a*, the amount of the developer supplied from the supply path 37-7 to the developer retaining space 34*c*-7 becomes smaller relative to the amount of the developer passing through the doctor gap D3, and therefore, the developer 32 is not stored in the developer retaining space 34*c*, which causes insufficient of the pumped up developer.

By contrast, if the width D1 of the communication hole 13*c* is excessively wide, similarly to comparative example 1 and 2, the developer is stored in the developer retaining space 34*c*-7 excessively.

Accordingly, when an experiment was executed to observe the amount of the developer depending on the change of the width D1 of the communication hole 13*c*, it was shown that when the width D1 of the communication hole 13*c* is set identical to three times as the doctor gap D4 the desirable image can be obtained.

Eighth Embodiment

An eighth embodiment is described below with reference to FIG. 31.

Figure 31:
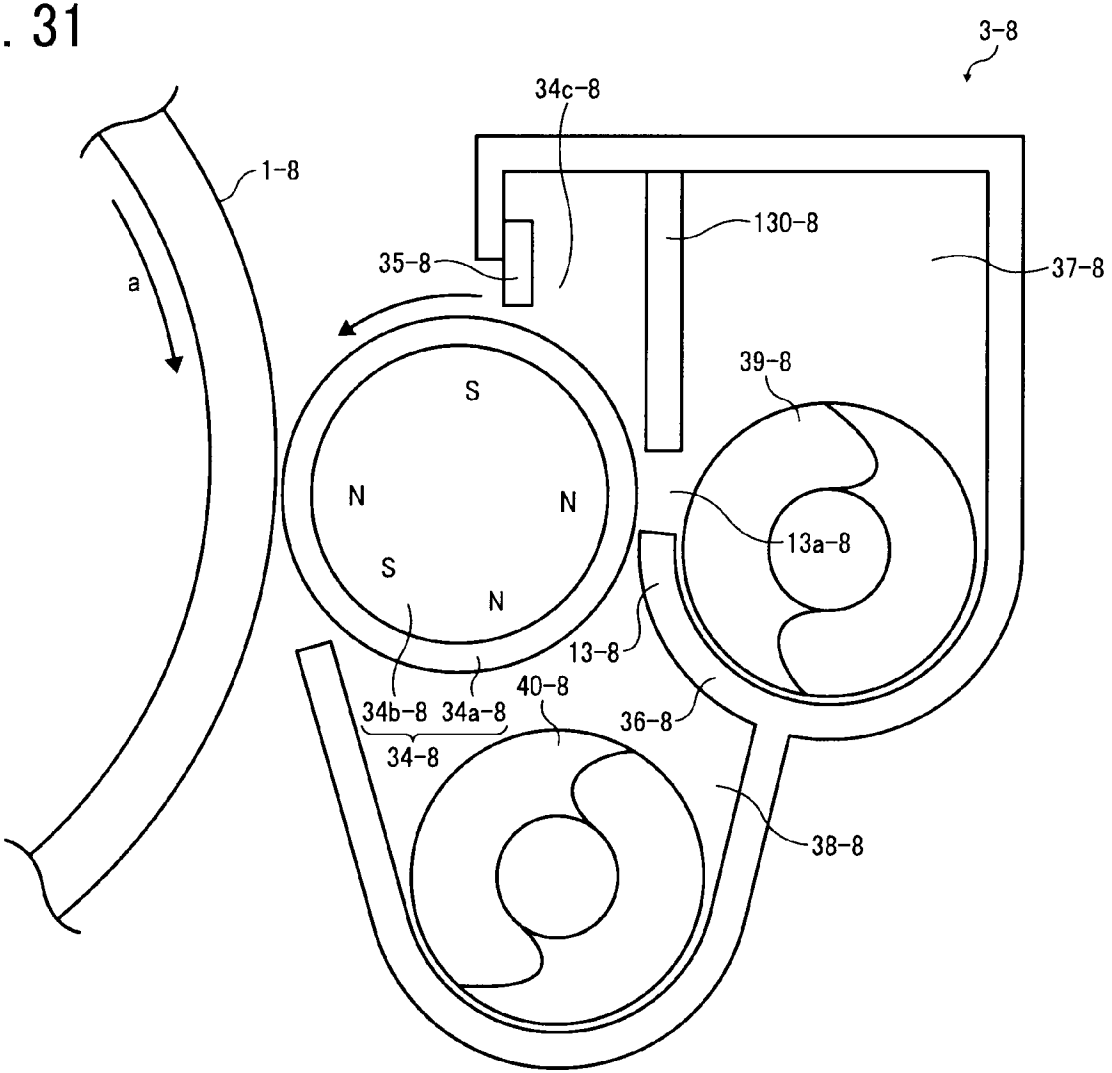
FIG. 31 is a diagram illustrating a development device according to an eighth illustrative embodiment, installable in the image forming apparatus shown in FIG. 1.

FIG. 31 is a diagram illustrating a development device 3-8 installable in the printer 100, according to the eighth embodiment. It is to be noted that, although the developer 32 is omitted in FIG. 31, the developer is provided in a supply path 37-8, a recovery path 38-8, and the developer retaining space 34*c*-8 in a developer container 33-8.

As shown in FIG. 31, in the development device 3-8 according to the eighth embodiment, the upper end of the screw 39-8 is positioned lower than the upper end of the developing sleeve 34*c*-8. Accordingly, as compared to the development device 3-7 shown in FIG. 20, the supply path 37-8 is positioned lower than the developer retaining space 34*c*-8 is.

In this configuration, the supply of the developer 32 from the supply path 37-8 to the developer retaining space 34*c*-8 is executed by attracting the developer 32 in the supply path 37-8 with the magnetic force from a magnet roller 34*b*-8 inside the developing sleeve 34*a*.

In the development device 3-7 shown in FIG. 20, because the supply path 37-7 is provided above the developing sleeve 34*a*, the developer 32 can be supplied from the supply path 37-7 to the developing sleeve 34*a* without using the magnetic force.

However, in this development device 3-8 shown in FIG. 31, when the developer 32 is supplied from the supply path 37-8 to the developing sleeve 34*a* due to the magnetic force, the developer 32 is stressed at it passes through the communication hole 13*c*-8.

Additionally, in the development device 3-8 according to the present embodiment, because the developer 32 is pumped up due to the magnetic force through the communication hole 13*c* defined by the shield wall 130-8 and the wall portion 13-8, the developer attracted by the magnetic force accumulates on the side of the shield wall 130 and the wall portion 13-8 in the supply path 37-8, and thus the supply of the developer may be prevented.

Therefore, it is preferable that the developer is supplied to the developing sleeve 34*a* without using the magnetic force, namely, the development device 3-7 is more preferable than the development device 3-8.

It is to be noted that, in the fall by gravity type development device in which the developer is supplied from above onto the developing sleeve, unevenness in the level 32*f*X of the developer 32X between the screw pitch fluctuates in the supply path 37X makes the level of the developer carried on the developing sleeve uneven. As the unevenness in the developer on the surface of the developing sleeve can be flattened to a certain extent upstream from the developing regulator 35X, this fluctuation of the developer on the developing sleeve is usually less likely to cause image failure.

However, when the level 32*f*X of the developer 32X in the supply path 37X is lower, the unevenness of the level 32*f*X of the developer 32X supplied to the developing sleeve becomes greater, and accordingly, the unevenness of the developer 32X supplied to the developing sleeve 34*a*X becomes greater. At this time, the developer is insufficiently flattened by the developing regulator 35X, which causes image failure, such as screw pitch unevenness.

By contrast, the development device 3-7 according to the seventh embodiment shown in FIG. 20, the developer 32 in the supply path 37-7 is supplied to the developing sleeve 34*a* from beneath the supply screw 39-7 in the supply path 37-7.

In general, because the portion lower than the supply screw in the supply path is filled with the developer, in the development device 3-7, the developer 32 is supplied from the lower portion of the supply path 37-7 filled with the developer.

Accordingly, even when the level 32*f*-7 of the developer 32 fluctuates, the developer 32 is reliably supplied to the developing sleeve 34*a*-7 and preferable image can be obtained without harmful effect from the unevenness of the developer 32.

By contrast, in the pumped up type unidirectional circulating development device that pumps the developer due to the magnetic force from magnet in the developing roller, the stress exerted on the developer passing through a portion partitioning the space upstream side of the developing doctor and the supply path becomes greater.

In another comparative example 1-2 that is a variation of the above-described comparative example 1 (pumped-up type unidirectional circulating development device), a development device includes a retention member (not shown?) that retains developer pumped up to a developing roller due to the magnetic force on the just upstream side from a developing doctor (developing regulator).

In this development device, the developer may receive forceful stress while the developer borne to the developing sleeve due to the developing sleeve passes through a retention gap between the retention member and the developing roller.

By contrast, in the development device 3-7 and 3-8 according to the seventh embodiment and eighth embodiment, the developer that passes through the communication hole 13*c* moves to the developer retaining space 34*c*-7 (34*c*-8) by the gravity, the developer that passes through the communication hole 13*c* is less likely to receive the stress.

In the development devices 3-7 and 3-8 according to the seventh embodiment and eighth embodiment, the developer supplied from the supply path 37-7(37-8) to the developing sleeve 34*a* and the developer that arrives the extreme downstream end portion of the supply path 37-7 are collected to the recovery path 38-7, and the developer is agitated in the recovery path 3-7 and then the developer is sent to the extreme upstream end portion of the supply path 37-7. That is, the developer in the developer container 33-7 circulates through two developer conveyance paths (supply path and the recovery path).

As for the unidirectional development device, the recovery path can be separated into a collecting path that collects the developer after passing the developing range and an agitating path that adjusts toner concentration and agitates the developer. In this configuration, the collecting path is arranged in parallel to the supply path, and the collecting path conveys the developer in a direction identical and parallel to the direction of the developer conveyance direction in the supply path 37.

Then, the developer arrived at the extreme downstream in the developer conveyance direction in the collecting path is sent to an extreme upstream of the developer conveyance direction in the agitating path that adjusts the toner concentration and agitates the developer. In addition, the developer that arrives at the downstream end in the developer conveyance direction in the supply path is sent to the upstream end of the agitating path. The developer supplied to the agitating path receives the toner whose amount is depend on the consumption of the toner in the developing range, after which, the developer is agitated and is conveyed in parallel to the supply path and opposite direction in the developer conveyance direction in the supply path. Accordingly, the developer reached the downstream end in the developer conveyance direction in the agitating path is sent to the upstream end in the developer conveyance direction in the supply path.

As described above, the configuration that includes the supply path, the collecting path and the agitating path can be adopted for the configuration according to the first embodiment to the eighth embodiment to convey the developer from the supply path to the developing sleeve (developer bearing member).

Additionally, in the image forming apparatus incorporating the above-described development device according to the first through eighth embodiments, because the toner concentration in the developer can be kept uniform in the developing range in the axis direction of the developer bearing member and the amount of the developer and the uniform developing gap can be kept uniform, image quality can be enhanced and the desirable image quality can be reliably attained even when the image forming apparatus is used for a long time.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer container, internally substantially divided by a partition into a supply path and a recovery path disposed parallel to the supply path;

a developer bearing member housed partially within the developer container and rotated while bearing developer on a surface thereof, to supply toner to a latent image formed on a surface of a latent image carrier within a developing range that is a portion of the developer bearing member disposed opposite the latent image carrier to develop the latent image with the toner;

a supply conveyance member disposed within the supply path to apply a force to convey developer through the supply path in an axial direction of the developer bearing member perpendicular to a direction in which the developer bearing member rotates while supplying the developer to a developer retaining space in communication with the supply path within the developer container, the developer retaining space retaining the developer to be conveyed by the developer bearing member as the developer bearing member rotates;

a recovery conveyance member disposed within the recovery path to apply a force to convey the developer through the recovery path through which the developer reaching a downstream end of the supply path is returned to an upstream end of the supply path in a direction of conveyance of the developer;

a communication pathway defined by a top of the partition and an interior ceiling of the developer container together, provided between the supply path and the developer retaining space, the communication pathway passing the developer from the supply path to the developer retaining space; and a developer softening member to soften the developer that is present above the partition, the developer softening member being provided at a position in the communication pathway between the top of the partition and the interior ceiling of the developer container, wherein the developer softening member provided in the communication pathway comprises a rotary member that rotates around a rotary shaft, wherein the rotary member comprises a paddle member whose fin rotates around the axis of rotation.

2. The development device according to claim 1, wherein developer on a surface of the developer bearing member downstream from the developing range in a direction in which the developer bearing member rotates is sent to the recovery path.

3. The development device according to claim 1, wherein a lower end of the supply conveyance member is positioned vertically above a center portion of the developer bearing member in a vertical direction.

4. The development device according to claim 1, wherein an axis of rotation of the rotary member extends along the axis direction of the developer bearing member, and the rotary member rotates in a direction in which a portion of the rotary member lower than the axis of the rotation moves from the developer retaining space to the supply path.

5. The development device according to claim 1, wherein the rotary member has at least one penetrating hole formed in the fin of the paddle member.

6. The development device according to claim 1, further comprising:

a developer regulator to restrict an amount of the developer borne on the surface of the developer bearing member, conveyed to the developing range; and a foreign object removal member to remove a foreign object present in the developer in a route through which the developer is conveyed from the supply path to the developer regulator via the communication pathway and the developer retaining space.

7. An image forming apparatus comprising:

a latent image carrier to carry a latent image;

a charging device to electrically charge a surface of the latent image carrier; and a development device to develop the latent image formed on the latent image carrier, the development device comprising:

a developer container, internally substantially divided by a partition into a supply path and a recovery path disposed parallel to the supply path;

a developer bearing member housed partially within the developer container and rotated while bearing developer on a surface thereof, to supply toner to the latent image formed on a surface of the latent image carrier within a developing range that is a portion of the developer bearing member disposed opposite the latent image carrier to develop the latent image with the toner;

a supply conveyance member disposed within the supply path to apply a force to convey developer through the supply path in an axial direction of the developer bearing member perpendicular to a direction in which the developer bearing member rotates while supplying the developer to a developer retaining space in communication with the supply path within the developer container, the developer retaining space retaining the developer to be conveyed by the developer bearing member as the developer bearing member rotates;

a recovery conveyance member disposed within the recovery path to apply a force to convey the developer through the recovery path through which the developer reaching a downstream end of the supply path is returned to an upstream end of the supply path in a direction of conveyance of the developer;

a communication pathway defined by a top of the partition and an interior ceiling of the developer container together, provided between the supply path and the developer retaining space, the communication pathway passing the developer from the supply path to the developer retaining space; and a developer softening member to soften the developer that is present above the partition, the developer softening member being provided at a position in the communication pathway between the top of the partition and the interior ceiling of the developer container, wherein the developer softening member provided in the communication pathway comprises a rotary member that rotates around a rotary shaft, the rotary member including a paddle member whose fin rotates around the axis of rotation.

* * * * *